US007712852B2

(12) United States Patent
Choi et al.

(10) Patent No.: US 7,712,852 B2
(45) Date of Patent: May 11, 2010

(54) DOUBLE DRAWER OF REFRIGERATOR

(75) Inventors: Chang Bong Choi, Changwon-si (KR); Heui Il Jeong, Gimhae-si (KR); Min Bon Koo, Changwon-si (KR); Min Gu Son, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 952 days.

(21) Appl. No.: 11/217,418

(22) Filed: Sep. 2, 2005

(65) Prior Publication Data

US 2006/0049731 A1 Mar. 9, 2006

(30) Foreign Application Priority Data

| | | |
|---|---|---|
| Sep. 7, 2004 | (KR) | 10-2004-0071242 |
| Sep. 7, 2004 | (KR) | 10-2004-0071243 |
| Sep. 7, 2004 | (KR) | 10-2004-0071244 |
| Sep. 7, 2004 | (KR) | 10-2004-0071245 |
| Sep. 7, 2004 | (KR) | 10-2004-0071246 |
| Sep. 7, 2004 | (KR) | 10-2004-0071247 |
| Sep. 22, 2004 | (KR) | 10-2004-0075783 |
| Sep. 22, 2004 | (KR) | 10-2004-0075784 |
| Sep. 22, 2004 | (KR) | 10-2004-0075785 |
| Sep. 22, 2004 | (KR) | 10-2004-0075786 |

(51) Int. Cl.
*A47B 96/04* (2006.01)

(52) U.S. Cl. ..... 312/402; 312/404; 312/301

(58) Field of Classification Search ..... 312/402, 312/404, 408, 330.1, 298, 301
See application file for complete search history.

(56) References Cited

U.S. PATENT DOCUMENTS

| | | | | |
|---|---|---|---|---|
| 1,614,507 | A * | 1/1927 | Vogt | 312/408 |
| 2,065,391 | A * | 12/1936 | Nance | 312/308 |
| 2,103,885 | A * | 12/1937 | Whalen | 312/404 |
| 2,719,772 | A * | 10/1955 | Petkwitz | 312/408 |
| 4,138,175 | A * | 2/1979 | Tattershall | 312/408 |
| 4,735,470 | A * | 4/1988 | Falk | 312/408 |
| 5,299,863 | A * | 4/1994 | Albright, Jr. | 312/404 |
| 5,820,239 | A * | 10/1998 | Christenson et al. | 312/404 |
| 5,980,009 | A * | 11/1999 | Atalla et al. | 312/408 |
| 6,148,813 | A * | 11/2000 | Barnes et al. | 312/408 |
| 6,364,136 | B1 * | 4/2002 | Weshler et al. | 312/408 |
| 6,641,239 | B2 * | 11/2003 | Kaiser | 312/404 |
| 7,082,783 | B2 * | 8/2006 | Uihlein et al. | 62/441 |
| 2004/0164654 | A1 | 8/2004 | Laible | |

FOREIGN PATENT DOCUMENTS

| | | | |
|---|---|---|---|
| CA | 1119229 | A | 3/1982 |
| EP | 0 628 776 | A1 | 12/1994 |
| EP | 0 718 572 | A1 | 6/1996 |
| GB | 751838 | A | 7/1956 |
| GB | 808696 | A | 2/1959 |
| GB | 2 247 068 | A | 2/1992 |
| JP | 10-311649 | A | 11/1998 |
| JP | 2001-201230 | A | 7/2001 |
| WO | WO-03/083392 | A1 | 10/2003 |

* cited by examiner

*Primary Examiner*—Hanh V Tran
(74) *Attorney, Agent, or Firm*—Birch, Stewart, Kolasch & Birch, LLP

(57) ABSTRACT

A double drawer for a refrigerator has a main drawer, an auxiliary drawer having drawings rails which assist the main drawer to slide out, and guide rails assisting the auxiliary drawer to slide out. A sufficient extended length can be secured, the space usability is improved. The durability can also be improved despite its extended length.

45 Claims, 27 Drawing Sheets

--Prior Art--

--Prior Art--

DOUBLE DRAWER OF REFRIGERATOR

BACKGROUND OF THE INVENTION

1. Field of Invention

The present invention relates to a drawer of a refrigerator, and more particularly, to a double drawer of a refrigerator comprising an auxiliary drawer having drawing rails which assist a main drawer for storing food to slide out and guide rails which assist the auxiliary drawer to slide out.

2. Description of the Prior Art

In general, a refrigerator is equipment for storing foods at a lower temperature. A refrigerator is used to store foods in a freezing or refrigerating state according to the foods to be stored therein. Cold air supplied into a refrigerator is produced by heat exchange with refrigerant. The refrigerant circulates in the refrigerator while undergoing a continuous refrigeration cycle of compression, condensation, expansion, and evaporation. Thus, the cold air produced by the heat exchange of the refrigerant is uniformly distributed into the refrigerator by means of the convection, thereby allowing foods in the refrigerator to be stored at a desired temperature.

FIG. 1 is a perspective view showing a refrigerator according to a prior art in a state where a drawer door is opened. As shown in the figure, a refrigerator main body 1 is shaped as a substantially rectangular hexahedron. Hinged doors 10 that can selectively open and close the right and left sides of the main body 1 are formed at an upper portion of the main body 1, and a drawer door 12 that can slides in and out of the main body 1 in a fore and aft direction is formed at a lower portion of the main body 1.

Although not shown in the figure, refrigerating and freezing chambers are formed in the refrigerator main body 1 in order to store various foods after freezing or refrigerating them. The interiors of the respective refrigerating and freezing chambers are provided with a variety of shelves, drawers, trays, and the like according to features of the various foods.

The temperature varies according to positions in the respective refrigerating and freezing chambers. The shelves, drawers, trays, and the like, which partition the respective inner spaces of the chambers, control the convection flow of the cold air in the main body 1, and then make it possible to control the temperature according to a position. In a general refrigerator, since it is hard to deliver the cold air to the lower portion of the main body 1, the temperature in the lower portion is relatively high.

In the meantime, a drawer chamber 20, which slides in and out by the drawer door 12 and has an inner space for storing food, is provided in the lower portion of the refrigerator main body 1. The drawer chamber 20, in which meat, fish, or food necessary to be stored for a long time is stored, comprises a plurality of accommodation spaces with various dimensions in order to store a variety of foods from small to large size.

The drawer chamber 20 is provided with a storage box 30 for storing relatively large-sized food and a pull drawer 40 for storing foods relatively smaller than those stored in the storage box 30. Among the foods necessary to be stored in a frozen state, the large-sized foods or the foods unnecessary to be divided are stored in the storage box 30.

The storage box 30 is connected to the lower portion of the drawer door 12 through hinges, and thus slides out forward along with the drawer door 12 when the drawer door 12 is pulled forward. Therefore, a user can look at the inside of the storage box 30 only by pulling the drawer door 12 and allow the storage box 30 to slide in and out without an additional operation.

In addition, upper ends of both side surfaces of the storage box 30 are fixed to one sides of three-step-telescopic rails 50, and the other sides of the rails 50 are fixed to both inside surfaces of the refrigerator main body 1. Therefore, the storage box 30 cooperates with the drawer door 12 and can thus slide in and out while being guided by the rails 50.

Meanwhile, the pull drawer 40 is installed in the upper portion of the storage box 30. In detail with reference to FIG. 2, the pull drawer 40 is formed in a drawer shape by allowing a plurality of wires to be crossed and bent.

The upper portion of the pull drawer 40 is opened. A front plate 42, which defines a partial front external appearance of the pull drawer 40, is provided in the front of the pull drawer 40. Rail mount brackets 44, to which second movable rails 54" to be mentioned below are fixed, are provided on the upper ends of both sides of the pull drawer 40.

The pull drawer 40 is pulled and pushed while sliding in the fore and aft direction along the three-step-telescopic rails 50, so that the user may store the desired foods. In addition, each of the rails 50 comprises a fixed rail 52 and a movable rail 54 sliding and moving in the fore and aft direction.

The fixed rails 52 are installed to horizontally extend on the insides of the refrigerator main body 1, i.e., on the inside surfaces of the right and left side walls of the drawer chamber 20, and serve to guide the slide of the movable rails 54.

In more detail, when the movable rails 54 are mounted in the fixed rails 52, rolling members provided on the movable rails 54 are brought into contact with surfaces of the fixed rails 52, so that the movable rails 54 slide along the fixed rails 52.

In the meantime, each of the movable rails 54 is composed of a first movable rail 54' and a second movable rail 54". The first movable rails 54' are mounted to the fixed rails 52 and thus configured to slide forward along the fixed rails 52, while the second movable rails 54" are mounted to the first movable rails 54' to slide forward along the first movable rails 54'.

At this time, the first movable rails 54' and the second movable rails 54" are provided with the rolling members. The rolling members roll in the fixed rails 52 for guiding the first movable rails 54' and with the first movable rails 54' for guiding the second movable rails 54", respectively.

Since the second movable rails 54" are fixed to the respective rail mount brackets 44, the pull drawer 40 can slide in the fore and aft direction along the rails 50. The extent that the pull drawer 40 slides out is determined according to an extended stroke of the rails 50, so that the dimensions of the pull drawer 40 are determined.

However, the pull drawer of a refrigerator so configured has the following problems.

That is, when the rails 50 comprising the first movable rails 54', the second movable rails 54" and the fixed rails 52 are pulled out while they continuously slide collinearly, the conventional refrigerator pull drawer is subjected to a moment caused from the weight of the foods accommodated in the pull drawer 40 itself and the extended length of the rails 50.

Therefore, when the extended length is large or many foods are accommodated, the moment exerted on the rails 50 is also increased, so that the rails 50 for supporting the pull drawer 40 are subjected to an excessive load. It causes the rails 50 to be damaged and raises a problem in that the rails 50 do not perform their inherent function.

In addition, when the moment is reduced by allowing the extended length to be decreased, the size of the pull drawer 40 is also reduced in proportion thereto. Accordingly, an amount of foods to be accommodated in the pull drawer 40 is decreased, which is ineffective. Further, since the inner space of the drawer chamber 20 in the rear of the pull drawer 40 cannot be available, there is a problem in that the practical usability of the inner storage space is deteriorated.

The rails 50 for causing the pull drawer 40 to slide comprise the first movable rails 54', the second movable rails 54" and the fixed rails 52. The pull drawer 40 further comprises the rail mount brackets 44 for fixing the rails 50 to the pull drawer 40. In addition, the rails 50 are formed of metallic material, while the rolling members mounted to the rails 50 are formed of the material different from the metal.

Therefore, the number of the components for operating the pull drawer 40 is unnecessarily increased, the kinds of the components are different from each other, and the manufacturing processes thereof are also different from each other, thus increasing the total man-hour needed for the works. Accordingly, there are problems in that the productivity is decreased as well as the production costs are increased.

In the meantime, the pull drawer 40 assembled to the rails 50 is installed all together to the drawer chamber 20, and is configured such that the pull drawer 40 is not easily separated in order not to escape. Thus, since the assembly of the pull drawer 40 and the rails 50 should be entirely disassembled when the pull drawer 40 is separated in order to be cleaned, managed, or the like, many problems are raised in the maintenance and services.

Furthermore, since the sliding order of the first and second movable rails 54' and 54" is not determined when the pull drawer 40 moves in the fore and aft direction by means of the first movable rails 54', the second movable rails 54" and the fixed rails 52, there is a problem in that much inconvenience is raised when using the pull drawer 40.

The pull drawer 40 is guided by guide rails (not shown) provided on both side surfaces of the pull drawer 40. When the pull drawer 40 is closed, the front end of the pull drawer 40 collides with the front end of the refrigerator. Thus, there is also a problem in that noises occur or the pull drawer 40 is damaged.

Since it is difficult to separate the rail 50 into parts since the movable rails 54', the second movable rails 54" and the fixed rails 52 are integrally assembled into the rails 50, the installation position of the pull drawer 40 is fixed. Thus, it is impossible to control the layout in the drawer chamber 20 using the pull drawer 40. Accordingly, there are also problems in that it is difficult to achieve flexible accommodation environments for accommodating a variety of foods in the drawer chamber 20 and that the space usability of the drawer chamber 20 is deteriorated.

SUMMARY OF THE INVENTION

Accordingly, the present invention is conceived to solve the aforementioned problems in the prior art. An object of the present invention is to provide a double drawer of a refrigerator, which comprises a main drawer, an auxiliary drawer having drawing rails which assist the main drawer to slide out, and guide rails assisting the auxiliary drawer to slide out, whereby a sufficient extended length can be secured, the space usability is improved, and the durability can also be improved in spite of its long extended length.

Another object of the present invention is to provide a double drawer of a refrigerator, which comprises a main drawer, an auxiliary drawer having drawing rails which assist the main drawer to slide out, and guide rails assisting the auxiliary drawer to slide out, whereby the double drawer can be easily cleaned or managed due to its easy assembly and disassembly.

A further object of the present invention is to provide a double drawer of a refrigerator, which comprises a main drawer, an auxiliary drawer, and guide rails, wherein the strength of the main drawer is considerably improved.

A still further object of the present invention is to provide a double drawer of a refrigerator, which comprises a main drawer, an auxiliary drawer, and guide rails, wherein the shock caused from the collision between the main drawer and the auxiliary drawer can be alleviated.

A still further object of the present invention is to provide a double drawer of a refrigerator, which comprises a main drawer, an auxiliary drawer, and guide rails, wherein the main drawer is detachably mounted to the auxiliary drawer and selectively mounted to upper and lower drawing rails of the auxiliary drawer, thereby considerably increasing the space efficiency in a refrigerator main body.

A still further object of the present invention is to provide a double drawer of a refrigerator, which comprises a main drawer, an auxiliary drawer, and guide rails, wherein the space usability of the auxiliary drawer can be considerably increased.

According to the present invention for achieving the objects, there is provided a double drawer of a refrigerator comprising a main drawer having a predetermined space defined therein for accommodating foods; an auxiliary drawer having an inner space therein for accommodating the main drawer, including drawing rails for guiding the main drawer to slide in a fore and aft direction and allowing the main drawer to slide in and out; and guide rails installed in a main body of the refrigerator to guide the auxiliary drawer to slide in the fore and aft direction.

According to an embodiment of the present invention, rolling members, which roll along the drawing rails, may be provided on both side surfaces of the main drawer to allow the main drawer to be smoothly slid. Depressed seating portions may be formed at both side ends of the drawing rail to allow the rolling member to be seated therein. More preferably, the seating portions are formed to limit a rolling motion of the rolling member and a resultant sliding motion of the main drawer against a predetermined sliding force which is applied to the main drawer or auxiliary drawer and determined to cause the auxiliary drawer to slide, whereby the main drawer and auxiliary drawer can be sequentially slid.

In addition, rolling members, which roll along the guide rails and allow the auxiliary drawer to slide smoothly, may be provided on both side surfaces of the auxiliary drawer. First rolling members, which roll along the drawing rails and allow the main drawer to be smoothly slid, may be provided on both side surfaces of the main drawer, and second rolling members, which roll along the guide rails and allow the auxiliary drawer to be smoothly slid, may be provided on both side surfaces of the auxiliary drawer.

Further, sliding guides, which are slidably mounted in the guide rails to guide the sliding motion of the auxiliary drawer, may be formed to protrude from both side walls of the auxiliary drawer. Preferably, rolling members are provided at positions corresponding to the sliding guides on both side surfaces of the auxiliary drawer, the rolling members rolling along the guide rails and causing the auxiliary drawer to slide smoothly.

The auxiliary drawer may be formed in a box shape with front and upper faces thereof opened.

The auxiliary drawer may be formed with one or more connection portions which connect both side walls of the auxiliary drawer to each other and are formed to traverse both the side walls of the auxiliary drawer. At this time, the connection portions may be formed in a rear surface of the auxiliary drawer or in a bottom surface of the auxiliary drawer. Further, the auxiliary drawer may be opened to all faces either except both side surfaces and the bottom surface or except both side surfaces and the rear surface.

The drawing rail may extend from a rear end of the auxiliary drawer to a front end of the auxiliary drawer and may be formed with a rolling member insertion opening which is opened forward for insertion of the rolling member to guide forward insertion of the main drawer. At this time, the drawing rail may be formed stepwise so that a bottom surface of an upper step portion thereof is positioned above a bottom surface of a lower step portion thereof. Preferably, the drawing rail comprises a movable portion extending from the rear end to a middle portion of the side wall of the auxiliary drawer to guide the movement of the rolling member; a vertical portion extending vertically upward at an extended end of the movable portion to prevent the main drawer from coming off; and an insertion portion extending from an upper end of the vertical portion of the auxiliary drawer to the front end of the side wall of the auxiliary drawer, the insertion portion being a passage for insertion of the rolling member.

The main drawer may be formed with a reinforcing rib for reinforcing the main drawer. A plurality of the reinforcing ribs may be formed on a bottom surface of the main drawer in a fore and aft direction thereof. The reinforcing rib may be formed to protrude downward from a bottom surface of the main drawer. A lower end of the reinforcing rib may slide on the auxiliary drawer while being brought into contact with the auxiliary drawer.

Preferably, a rolling member for allowing the auxiliary drawer to easily move in a fore and aft direction thereof and a sliding guide for guiding the auxiliary drawer to move in the fore and aft direction are provided on each side surface of the auxiliary drawer, and a receiving portion is formed on the guide rail in the fore and aft direction to receive both the rolling member and the sliding guide and to slidably guide the rolling member and the sliding guide.

At this time, the receiving portion and the sliding guide may be formed with a rail catching portion and a guide catching portion, respectively, which are formed in a shape corresponding to each other to be caught to each other. Particularly, the rail catching portion may be formed at a front end of the receiving portion.

Preferably, at least one of the main drawer and the auxiliary drawer is provided with a shock absorbing member for alleviating collision between the auxiliary drawer and the main drawer. Preferably, the shock absorbing member is formed at a front end of the auxiliary drawer. More preferably, the shock absorbing member is formed of an elastic material, particularly, a rubber material.

Preferably, each of the drawing rails includes an opening type drawing rail formed to be bored through each side wall of the auxiliary drawer, and sliding members are formed on both side surfaces of the main drawer to be fitting into and slid along the opening type drawing rails. At this time, the opening type drawing rail may be formed to extend from a rear end at least to a middle portion of the auxiliary drawer. Further, seating portions are formed to be depressed downward at both side ends of each opening type drawing rail, each seating portion being somewhat larger than the sliding member. Preferably, the seating portions are formed to limit a sliding motion of the sliding member and the main drawer against a predetermined sliding force applied to the main drawer or auxiliary drawer, the force being determined to cause the auxiliary drawer to slide, whereby the main drawer and the auxiliary drawer can be sequentially slid. An insertion portion, which is a passage for insertion of the sliding member, may be formed to be opened upward at the rear end of the drawing rail.

The double drawer further comprises auxiliary rails formed in the refrigerator main body to guide the sliding motion of the main drawer separated from the auxiliary drawer. At this time, the main drawer may be selectively separated from the auxiliary drawer and mounted to the auxiliary rails, and an auxiliary drawer door may be provided on the auxiliary drawer to selectively close a face of the auxiliary drawer, thereby defining an additional accommodating space in the auxiliary drawer.

The auxiliary drawer may further comprise door guides in which the auxiliary drawer door is accommodated to guide a forward sliding motion of the auxiliary drawer door. Preferably, the auxiliary drawer door slides out forward and pivots upward when the auxiliary drawer is closed and is mounted on a bottom surface of the auxiliary drawer when the auxiliary drawer is opened.

Preferably, the drawing rails comprise upper drawing rails and lower drawing rails, and the main drawer is selectively mounted on the upper drawing rails and lower drawing rails. At this time, rolling members or sliding members capable of rolling along the upper drawing rails or lower drawing rails while being brought into contact with the drawing rails may be provided on both side surfaces of the main drawer. Further preferably, upper insertion portions, each of which is a passage for insertion of the rolling member or sliding member, are formed at rear ends of the upper drawing rails, and lower insertion portions, each of which is another passage for insertion of the rolling member or sliding member, are formed at front ends of the lower drawing rails. More preferably, the lower drawing rails are formed to extend from a front end of the side wall to a rear end of the side walls of the auxiliary drawer.

The auxiliary drawer may further comprise a partition for partitioning an inner space of the auxiliary drawer. At this time, a length between front and rear ends on a floor surface of the main drawer may be equal to or slightly larger than a length from a front end of a floor surface of the auxiliary drawer to the partition. In addition, the drawing rails may be formed to extend from positions, at which the partition is formed, to front ends of both side walls of the auxiliary drawer. More preferably, a front end of each of the drawing rails is opened and defines an insertion opening that is a passage for insertion of the rolling member or sliding member provided on both the side surfaces of the main drawer. Still more preferably, catching portions are formed on the drawing rails to protrude upward, thereby preventing the rolling member or sliding member provided on both side surfaces of the main drawer from sliding out.

The drawing rails and the rolling members may be formed of the same material. Alternatively, the guide rails and the rolling members may be formed of the same material. Preferably, the main drawer, the auxiliary drawer and the guide rails are injection molded.

BRIEF DESCRIPTION OF THE DRAWINGS

The above and other objects, features and advantages of the present invention will become apparent from the following description of preferred embodiments given in conjunction with the accompanying drawings, in which:

FIG. 5 is a perspective view showing that the refrigerator double drawer shown in FIG. 4 slides in;

DETAILED DESCRIPTION OF THE PREFERRED EMBODIMENT

Figure 1:
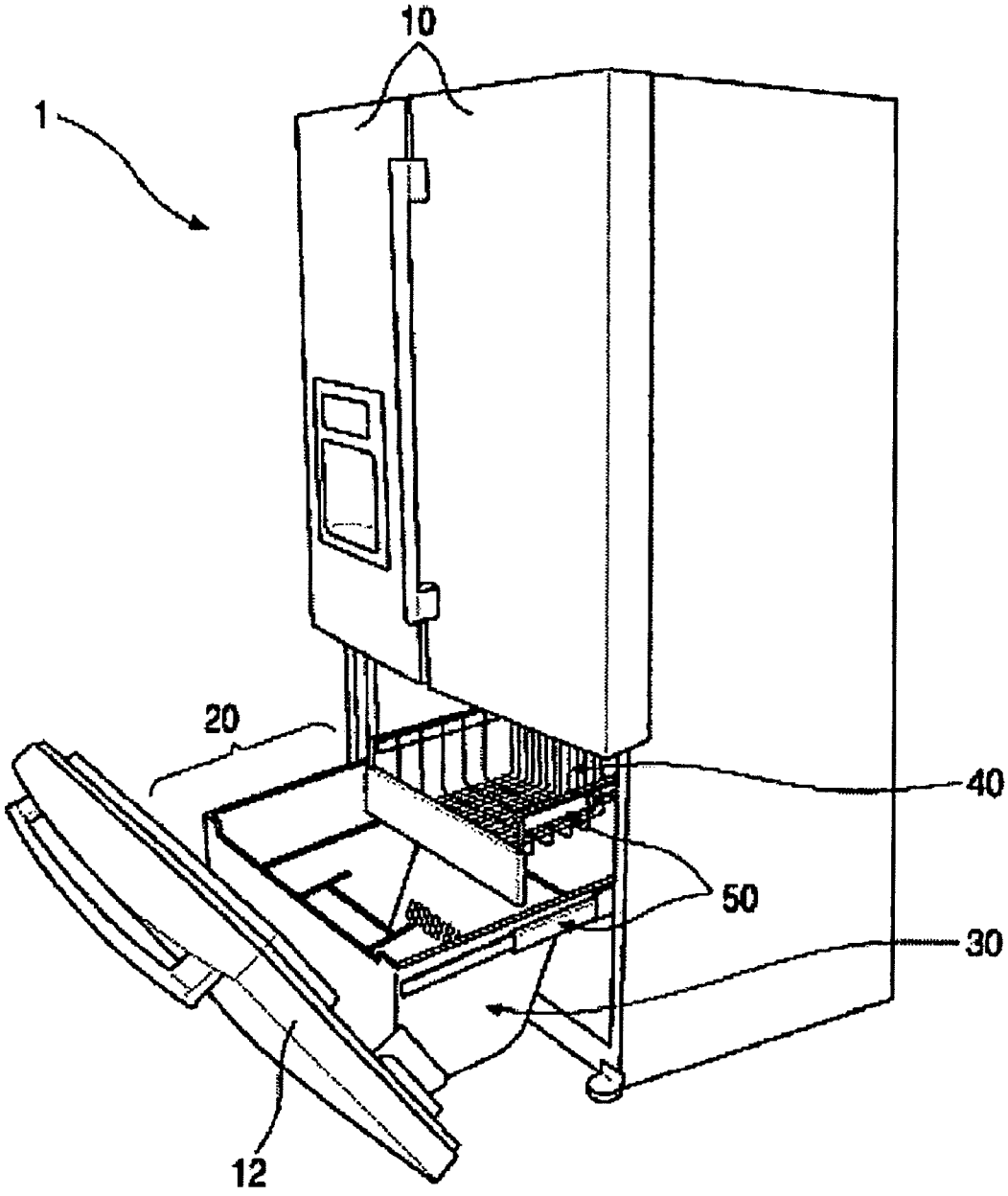
FIG. 1 is a perspective view showing a refrigerator according to a prior art in a state where a drawer door is opened.
Figure 2:
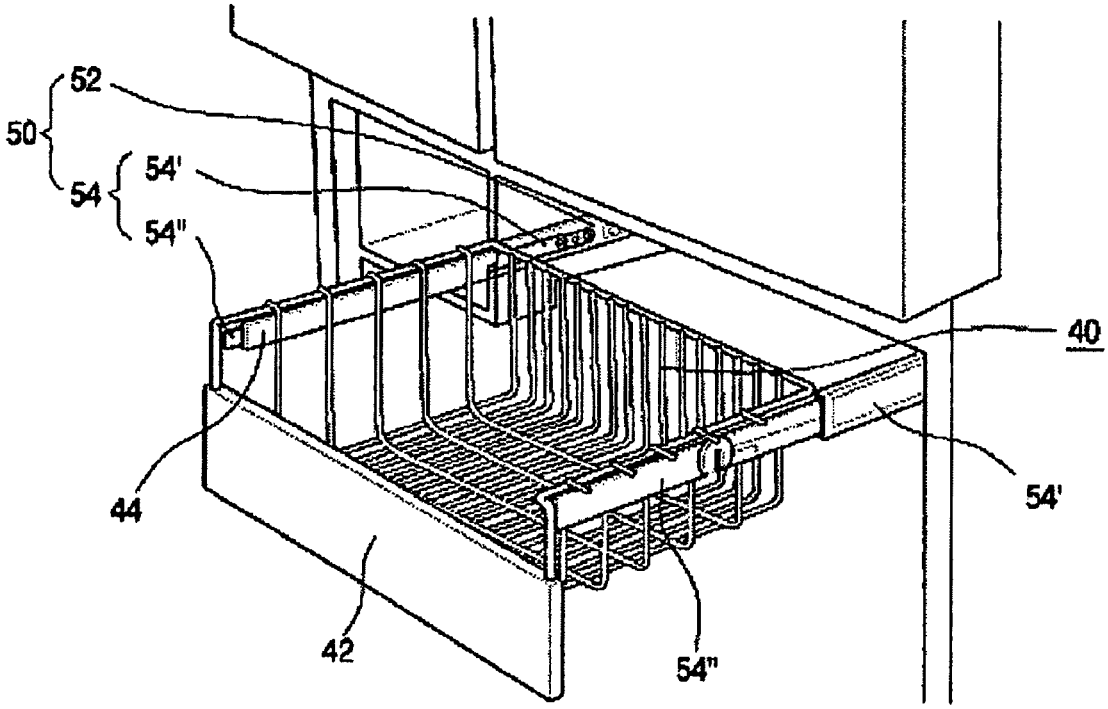
FIG. 2 is a partial perspective view showing a pull drawer of the refrigerator according to the prior art.

Hereinafter, a variety of embodiments according to the present invention will be described. When the embodiments are described, like reference numerals will be used to designate like elements and the repeated descriptions will be omitted for the brevity of the specification.

Figure 3:
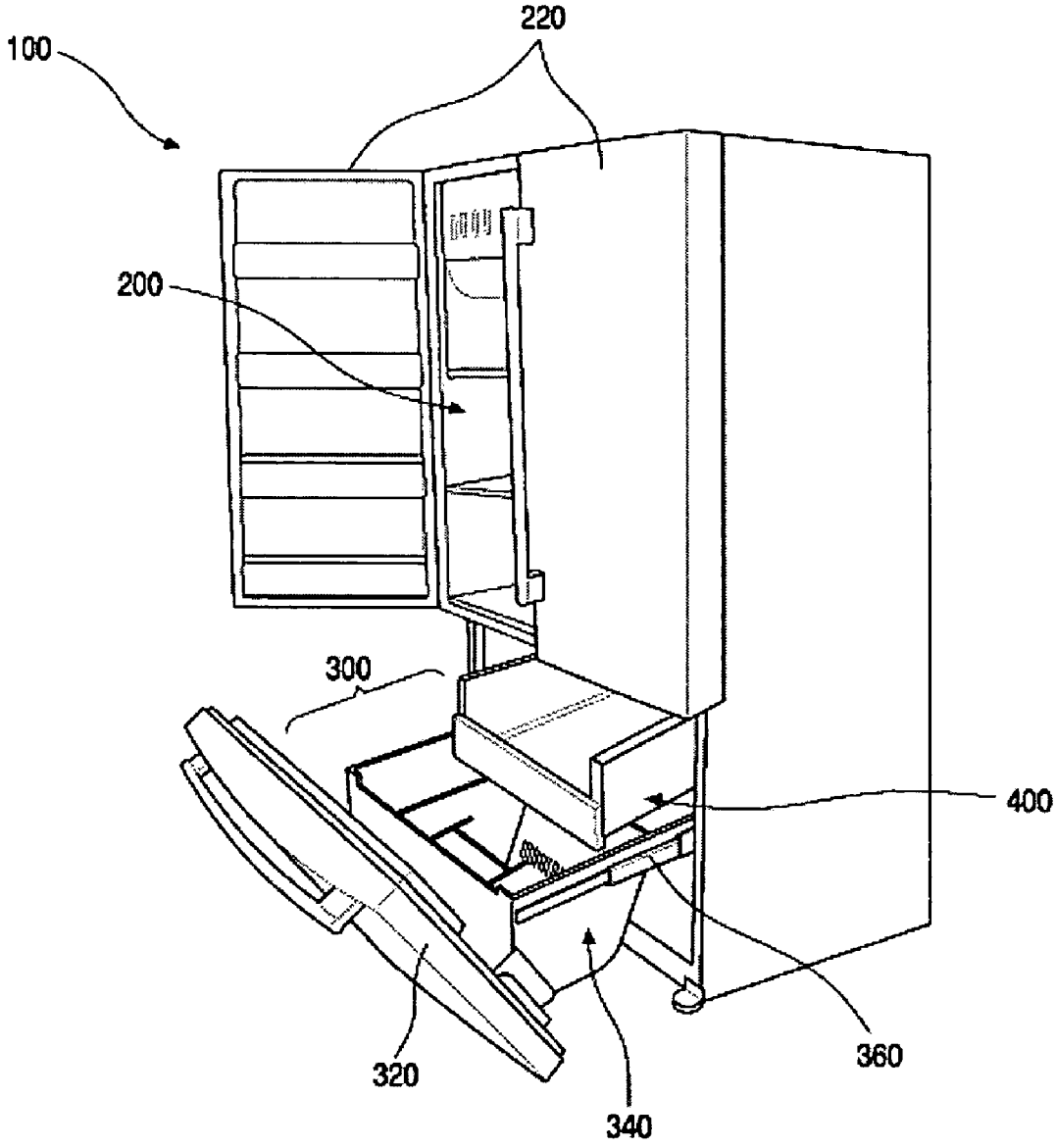
FIG. 3 is a perspective view showing a refrigerator, in which a double drawer according to the present invention is employed, in a state where doors are opened.

FIG. 3 is a perspective view showing a refrigerator, in which a double drawer according to the present invention is employed, in a state where doors are opened to show the refrigerator double drawer. As shown in the figure, a refrigerator main body 100 comprises a refrigerating chamber 200 and a drawer chamber 300.

The refrigerating chamber 200 is formed on an upper portion of the main body 100 and partitioned into two portions of the left and right sides. In order to effectively accommodate various kinds of foods, trays, shelves and drawers of various shapes are installed in the refrigerating chamber 200 and partition the inner space thereof.

Therefore, the stream of the cold air supplied from a side of the main body 100 is influenced by the trays, shelves and drawers, and thus, the convection flow is limited and controlled. A user can accommodate and store the foods in appropriate positions according to properties of the temperature due to the difference of the cold air supply.

In the meantime, hinged doors 220 for opening and closing the refrigerating chamber 200 in the upper portion of the main body 100 are provided on the left and right sides of the main body 100. The respective hinged doors 220 are installed to be pivotable outward at both side ends of the main body 100 through hinged joint.

Thus, the respective hinged doors 220 individually close the left and right sides of the refrigerating chamber 200, so that the independent spaces are defined. If desired, any one side of the refrigerating chamber 200 may be used as a freezing chamber.

In the meantime, the drawer chamber 300 is formed in the lower portion of the main body 100 in which the refrigerating chamber 200 is provided. The drawer chamber 300 in the form of a drawer, which defines a storage space capable of being pulled and pushed, is generally used as a freezing chamber. The drawer chamber 300, in which fish, meat or food necessary to be stored for a long time is stored after frozen, is provided with an additional cold air supply hole, thus having a powerful freezing capability.

Further, the drawer chamber 300 may be used exclusively as a refrigerating chamber instead of a freezing chamber. At this time, the storage space of the drawer chamber 300 is formed to be wider, so that fruit, vegetable or relatively large or heavy food, which is difficult to be put in a container will be able to be stored.

A drawer door 320 for closing the inside of the drawer chamber 300 is formed in the front of the drawer chamber 300. A lower end of the drawer door 320 is hingedly connected to a lower end of a storage box 340 for storing foods. The storage box 340 is mounted with three-step-telescopic rails 360, which slide and extend in the fore and aft direction.

One side of each three-step-telescopic rail 360 is fixed to each inside surface of both walls of the drawer chamber 300, so that the storage box 340 can slide along the three-step-telescopic rails 360 in the fore and aft direction. By pulling and pushing a handle formed on an upper portion of the drawer door 320, the storage box 340 and the drawer door 320 slide in and out together.

In the meantime, an upper portion of the drawer chamber 300 is partitioned into right and left sides, wherein an ice machine for automatically making ice and storing the ice therein is provided on the left side and a double drawer 400 for storing the foods somewhat small to be stored in the storage box 340 or necessary to be separately stored is provided on the right side.

Figure 4:
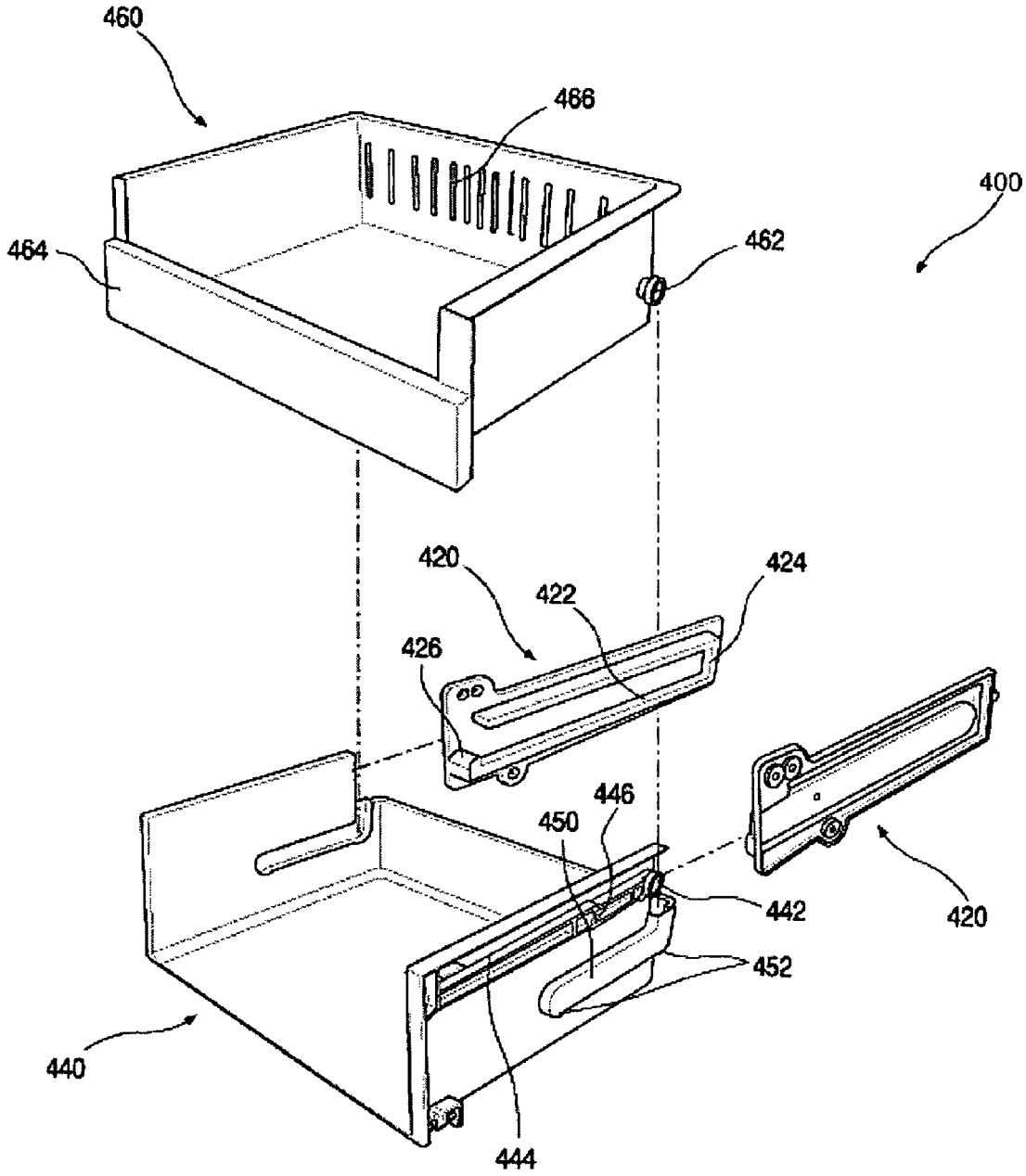
FIG. 4 is an exploded perspective view showing a refrigerator double drawer according to a first embodiment of the present invention.
Figure 5:
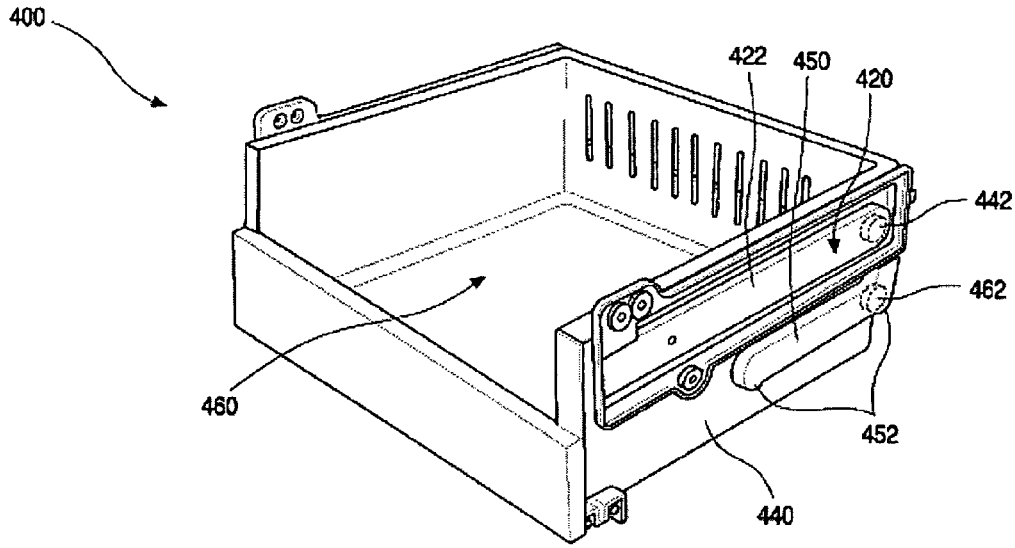
Figure 6:
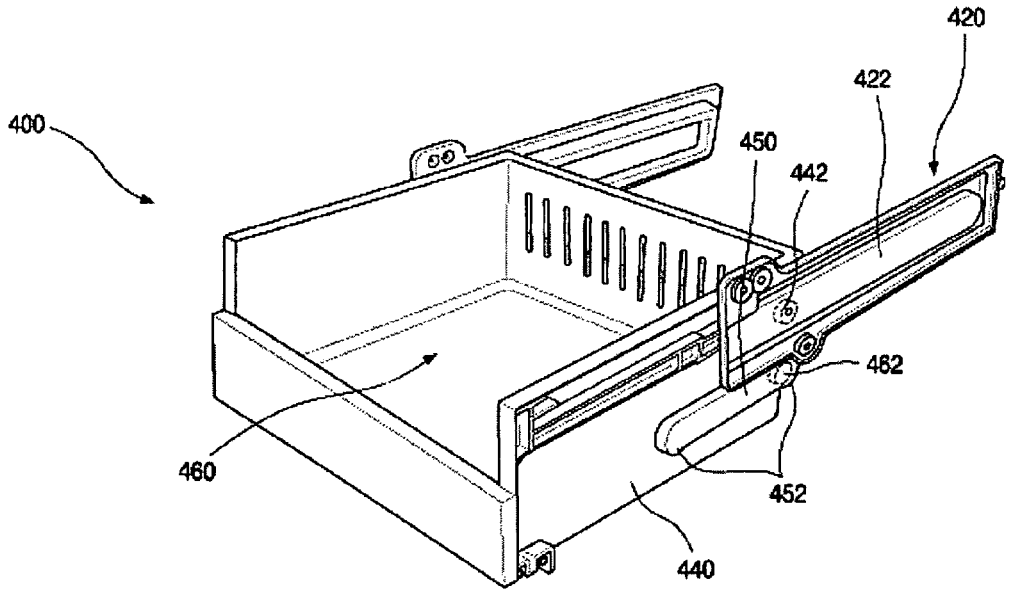
FIG. 6 is a perspective view showing the refrigerator double drawer shown in FIGS. 4 and 5 where an auxiliary drawer slides out.
Figure 7:
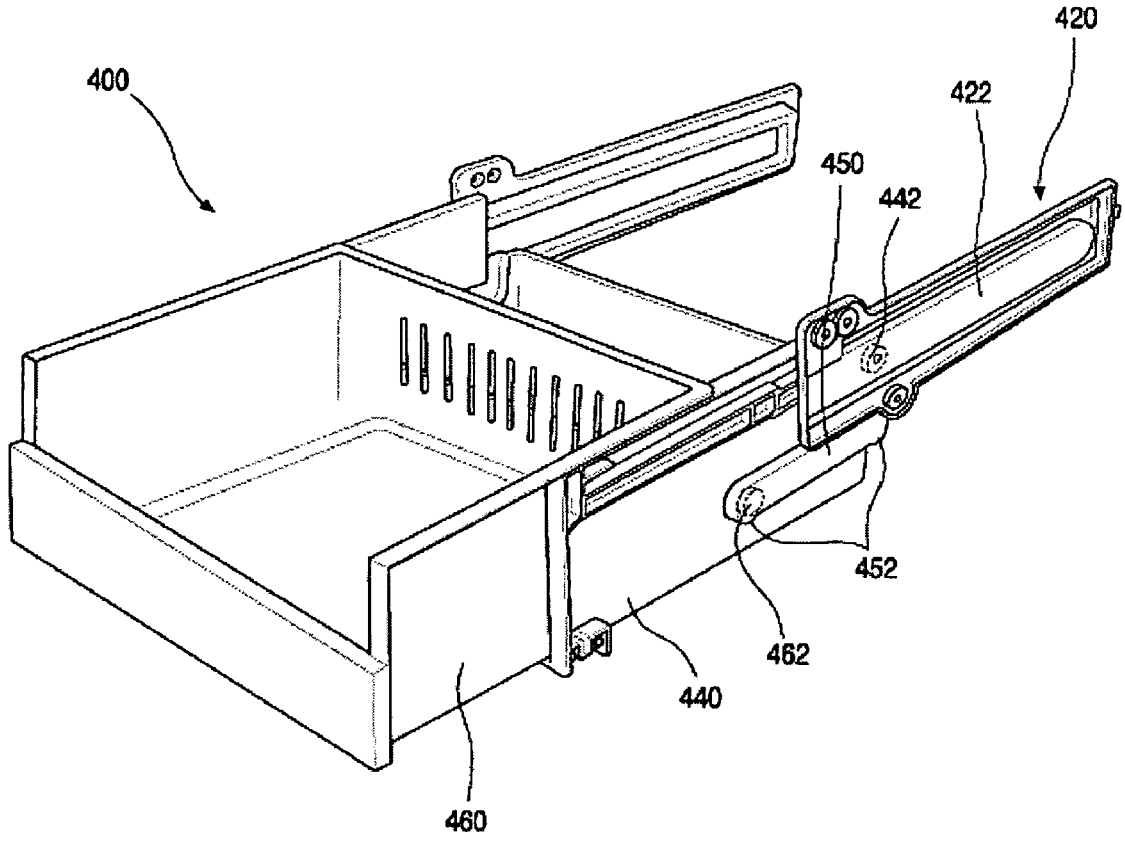
FIG. 7 is a perspective view showing the refrigerator double drawer shown in FIGS. 4 and 5 where the auxiliary drawer and a main drawer slide out together.

FIG. 4 is an exploded perspective view showing a refrigerator double drawer according to a first embodiment of the present invention; FIG. 5 is a perspective view showing a state where the refrigerator double drawer according to the embodiment of the present invention is closed; FIG. 6 is a perspective view showing the refrigerator double drawer in a state where an auxiliary drawer slides out; and FIG. 7 is a perspective view showing the refrigerator double drawer in a state where the auxiliary drawer and a main drawer slide out together.

As shown in FIGS. 4 to 7, the double drawer 400 comprises guide rails 420, an auxiliary drawer 440, and a main drawer 460. Here, first rolling members 462 are provided on both side surfaces of the main drawer 460 which is provided for accommodating and storing food, while second rolling members 442 are provided on both side surfaces of the auxiliary drawer 440 which allows the main drawer 460 to slide in a state where the main drawer 460 is accommodated in the auxiliary drawer 440. In addition, the guide rails 420 are installed to the refrigerator main body in order to slidably guide the auxiliary drawer 440 in which the main drawer 460 is accommodated.

The guide rails 420, which guide the auxiliary drawer 440 to slide in and out, extend horizontally and are installed in the refrigerator main body 100. The guide rails 420 are formed with receiving portions 422 for guiding the rolling of the second rolling members 442, respectively. The receiving portions 422, which receive the second rolling members 442 installed on the auxiliary drawer 440, are longitudinally formed with a predetermined width along the substantially middle portions of the guide rails 420.

Each of the second rolling members 442 includes the member for providing the smooth slide, such as a roller or bearing. When a roller is used as the second rolling member 442, it is possible to form a roller of the same material as the auxiliary drawer 440.

The receiving portion 422 is defined by a protrusion 424 of "⊃" shape (as viewed from the side) in the peripheral portion of the receiving portion 422. The protrusion 424 is formed to protrude by a predetermined height so that the second rolling member 442 is received in the receiving portion 422 and to have a front upper corner opened so that the second rolling member 442 is inserted into the receiving portion 422 from the front.

In addition, a rail catching portion 426 is formed on the lower front end of the protrusion 424 to somewhat protrude upward as viewed from the side. The rail catching portion 426 protrudes to have its end of a substantially hook shape.

The guide rails 420 are installed on the inside of the refrigerator main body 100, more particularly, at corresponding positions of left and right upper wall surfaces of the inside of the drawer chamber 300 (see FIG. 3). Further, the auxiliary drawer 440 is slidably mounted to the guide rails 420.

The auxiliary drawer 440 is formed in a hexahedral box shape with the front, upper and rear portions opened. The second rolling members 442 are provided on upper rear portions of both side surfaces of the auxiliary drawer 440. The second rolling members 442, which roll on portions of the receiving portions 422, cause the auxiliary drawer 440 to slide along the guide rails 420.

In addition, sliding guides 444 are formed on upper portions of both the side surfaces of the auxiliary drawer 440 to which the second rolling members 442 are mounted. The sliding guides 444, which prevent the auxiliary drawer 440 from sagging downward when the auxiliary drawer 440 slides out forward along the guide rails 420, protrude to have a shape similar to the receiving portions 422 so as to be supported on the protrusions 424 formed on that the guide rails 420.

The sliding guides 444 are formed to extend from the portions, where the second rolling members 442 are installed, to the front end of the auxiliary drawer 440. Guide catching portions 446 are formed on the sliding guides 444 at the portions adjacent to the second rolling members 442

The guide catching portions 446, which are formed to protrude downward to have a shape similar to the rail catching portions 426, are brought into contact with the rail catching portions 426, thus causing the auxiliary drawer 440 no more to slide out. Furthermore, the guide catching portions 446 serve to cause the main drawer 460 to slide out sequentially after the auxiliary drawer 440 slides out, as described below in detail.

In the meantime, drawing rails 450 are formed on both side walls of the auxiliary drawer 440. The drawing rails 450, which enable the main drawer 460 to slide in the fore and aft direction, receive the first rolling members 462 installed to the main drawer 460.

The drawing rails 450 are formed below the sliding guides 444 by allowing portions of the auxiliary drawer 440 to be depressed from the inside to the outside thereof by a predetermined width, and extend from the rear ends of both the side walls of the auxiliary drawer 440 up to substantially center portions thereof.

As viewed from the side, an end of each drawing rail 450 is formed round, and seating portions 452 are formed on lower portions of both ends of the drawing rail 450. The seating portions 452, which are depressed downward with a predetermined curvature, function as temporary catching portions when the first rolling members 462 mounted to the drawing rails 450 are seated in the seating portions 452.

In the meantime, as viewed from the side, the other end of each drawing rail 450, which is at a rear end side of the auxiliary drawer 440, extends vertically upward, wherein an extended end is opened. Therefore, the first rolling members 462 mounted to the main drawer 460, which will be described below, may be downward inserted into the drawing rails 450 of the auxiliary drawer 440 through the rear ends thereof.

Further, the rear face of the auxiliary drawer 440 is formed with a substantially upper half portion opened, thus making it possible to easily insert the main drawer 460 into the drawing rails 450 and causing the drawing rails 450 not to influence the guide rails 420.

The main drawer 460 is seated in the auxiliary drawer 440. The main drawer 460, in which foods are stored, is formed in a box shape with the upper portion being opened and is generally formed somewhat smaller than the auxiliary drawer 440 to be seated in the auxiliary drawer 440.

Further, in order for the external appearance of the main drawer 460 to look better when it is seated in the auxiliary drawer 440, edges of the main drawer 460 except its rear portion are outward bent at a right angle.

A front plate 464 defining a front external appearance of the main drawer 460 is formed on the front of the main drawer 460. The front plate 464 functions as a handle when the user intends to pull the main drawer 460.

The first rolling members 462 of the main drawer 460 are formed to have the same shape as the aforementioned second rolling members. The first rolling members 462 are accommodated in the drawing rails 450 and roll in the drawing rails 450. The first rolling members 462 assist the main drawer 460 to smoothly slide in the auxiliary drawer 440.

The first rolling members 462 are installed to substantially middle portions of the rear sides of both the side surfaces of the main drawer 460, i.e., at positions corresponding to those where the drawing rails 450 are formed. That is, the first rolling members 462 are installed so that they can be received in the drawing rails 450 smoothly when the main drawer 460 is seated in the auxiliary drawer 440.

Each of the first rolling members 462 includes the member for providing the smooth slide, such as a roller or bearing. When a roller is used as the first rolling member 462, it is possible to form a roller of the same material as the main drawer 460. In addition, cold air inlets 466 are further formed in the rear wall of the main drawer 460 in order for the cold air supplied from the rear portion thereof to flow in the main drawer 460 smoothly.

In the meantime, the main drawer 460, the auxiliary drawer 440, and the guide rails 420 are formed of the same material, for example, by injection molding the material such as plastic.

FIGS. 8 to 11 are sectional views showing how the aforementioned refrigerator double drawer is used. Referring to FIGS. 8 to 11, the operation of the refrigerator double drawer according to the present embodiment will be described as follows.

Figure 8:
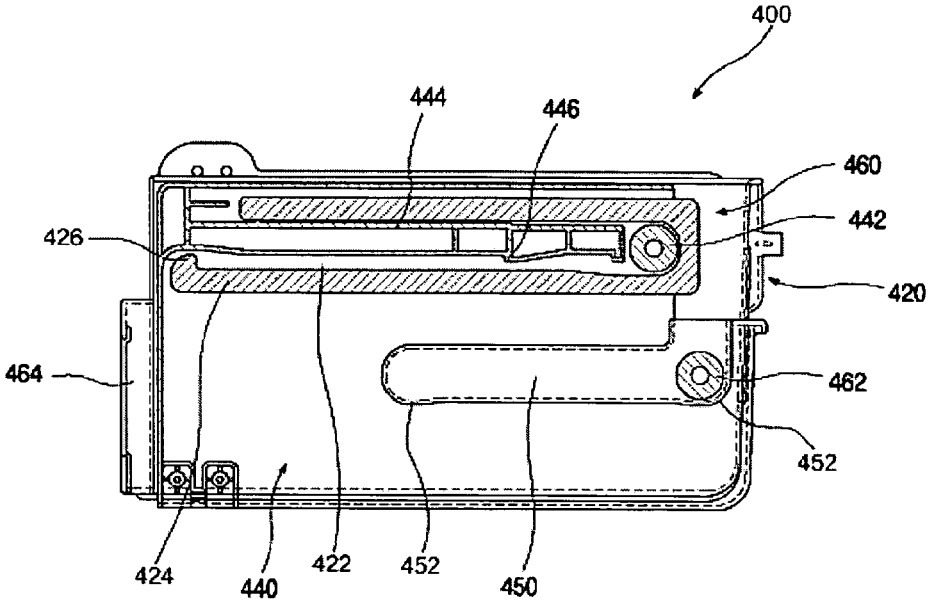
FIGS. 8 to 11 are sectional views sequentially showing that the auxiliary and main drawers slide out in order to explain the operation of the refrigerator double drawer shown in FIGS. 4 to 7.

A state where the double drawer 400 is accommodated in the refrigerator will be first discussed. As shown in FIG. 8, the main drawer 460 is accommodated in the auxiliary drawer 440 and the rear surfaces of the main and auxiliary drawers 460 and 440 are in contact with each other. The second rolling members 442 of the auxiliary drawer 440 are positioned at the rear ends of the guide rails 420, while the first rolling members 462 of the main drawer 460 are positioned at the rear ends of the drawing rails 450 formed on the auxiliary drawer 440. Therefore, the main drawer 460 except a portion of the front wall thereof is fully accommodated in the auxiliary drawer 440, and the guide rails 420 are positioned on both the side surfaces of the auxiliary drawer 440.

In order to store or take out the foods in the double drawer 400 installed the drawer chamber 300 of the refrigerator in a state where the double drawer 400 is accommodated in the refrigerator as above, the user grips a handle formed on the drawer door 320 and then pulls out the drawer door 320 forward. When the drawer chamber 300 is opened as above, the storage box 340 is completely exposed to the outside. At this time, the double drawer 400 provided above the storage box 340 is in a state where it is accommodated in the refrigerator as shown in FIGS. 3

Figure 9:
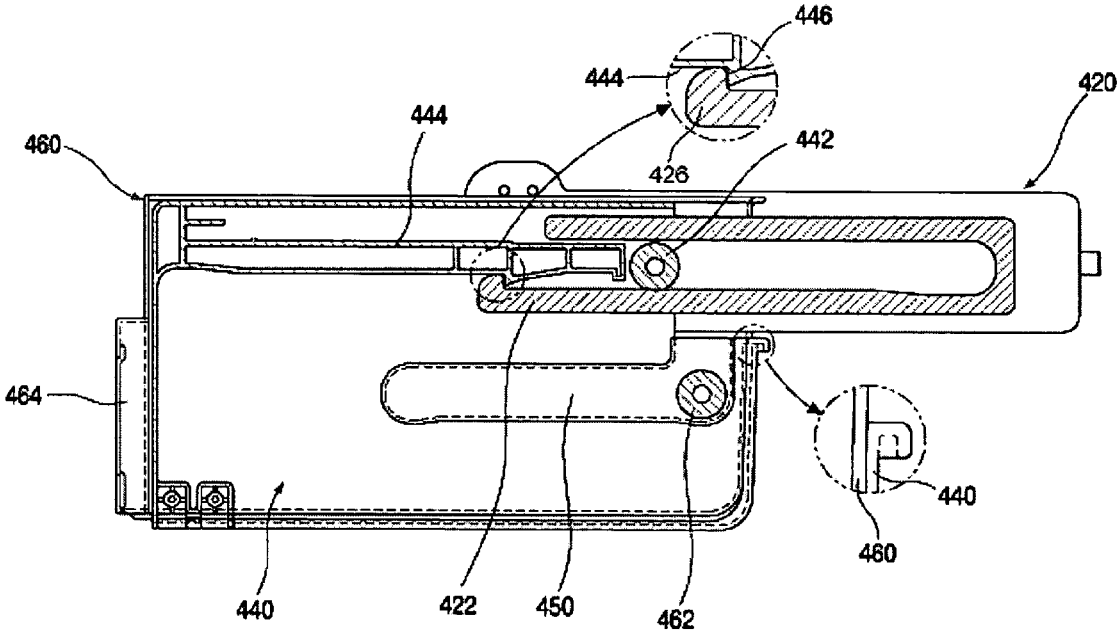

As shown in FIGS. 8 and 9, when the front plate 464 is gripped by hand and pulled forward, the auxiliary drawer 440 slides out along the guide rails 420 from the position shown in FIG. 8 to the position shown in FIG. 9. In such a process, the second rolling members 442 of the auxiliary drawer 440 roll on portions of the receiving portions 422 of the guide rails 420. The rolling of the second rolling members 442 assists the auxiliary drawer 440 to slide and be pulled smoothly.

At this time, when the auxiliary drawer 440 initially slides out, the main drawer 460 slide out before the auxiliary drawer 440 slides or does not slide out at the same time when the auxiliary drawer 440 slides. The reason is that since the first rolling members 462 are seated in the seating portions 452 formed on the rear ends of both the side walls of the drawing rails 450, a relatively large force is required to allow the first rolling members 462 to roll against the seating portions 452.

On the other hand, although the rear ends of the guide rails 420, in which the second rolling members 442 roll, are formed at an inclined angle, since a force for causing the second rolling members 442 to ascend the inclination is relatively smaller than that for causing the first rolling members 462 to go over the seating portions 452, the auxiliary drawer 440 first slides out when the front plate 464 is slowly pulled.

When the user grips the front plate 464 and pulls it slowly forward, the guide catching portions 446 formed on the auxiliary drawer 440 and the rail catching portions 426 formed on the guide rails 420 are finally brought into contact with and caught to each other. Thus, the auxiliary drawer 440 no more slides out. The position in which the auxiliary drawer 440 no more slides out as above is well shown in FIG. 9.

Figure 10:
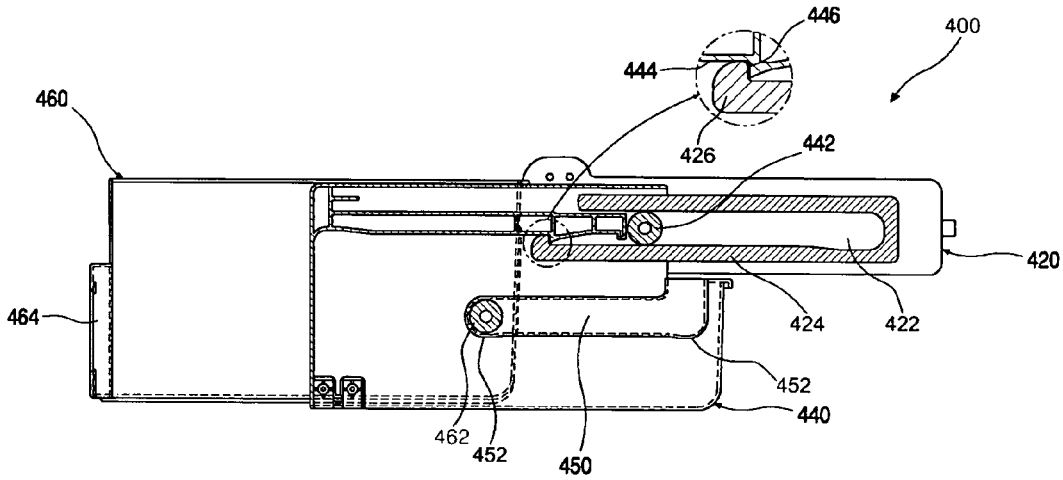

As shown in FIGS. 9 and 10, if the user pulls the main drawer 460 continuously after the guide catching portions 446 and the rail catching portions 426 are brought into contact with each other, the force for causing the first rolling members 462 to go over the seating portions 452 occurs, so that the first rolling members 462 roll on portions of the drawing rails 450.

Due to the rolling of the first rolling members 462, the main drawer 460 slides out forward from the inside of the auxiliary drawer 440. If the main drawer 460 is continuously pulled out, the first rolling members 462 are seated in the seating portions 452 positioned at the front of the drawing rails 450, the pulling of the main drawer 460 no more progresses. The position in which the main drawer 460 is completely pulled is well shown in FIG. 10.

When the main drawer 460 completely slides out from the auxiliary drawer 440, the main drawer 460 is exposed from the inside to the outside of the drawer chamber 300 of the refrigerator. At this time, the user may put or take foods in or out of the double drawer 400 (See FIG. 3).

Figure 11:
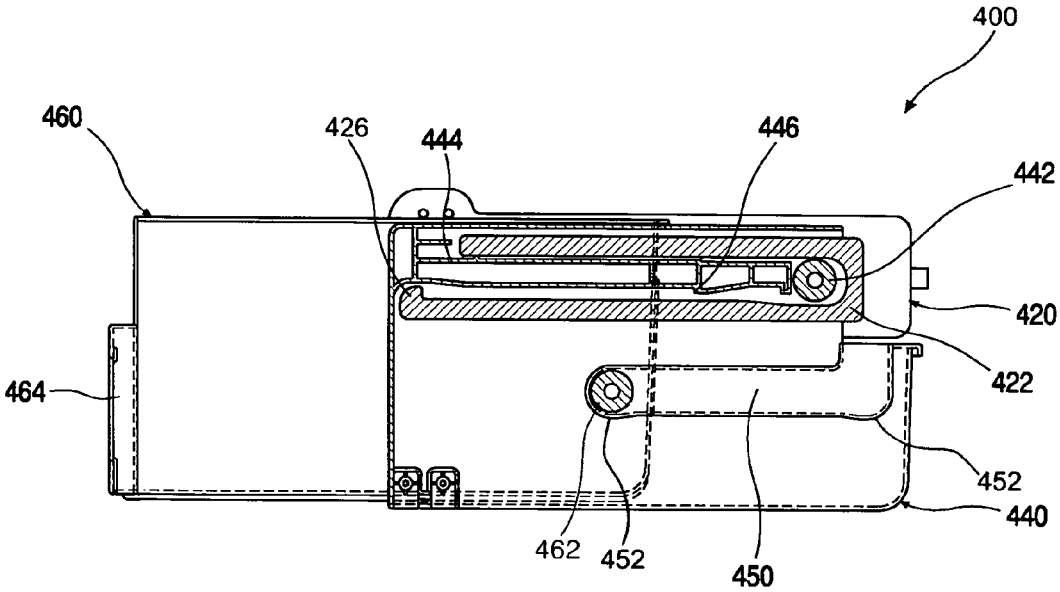

In the meantime, when the front plate 464 of the main drawer 460 is pushed in order to slide in the double drawer 400, due to the operation of the seating portions 452, the auxiliary drawer 440 first slides in while the second rolling members 442 roll from the position shown in FIG. 10 to the position shown in FIG. 11, and subsequently, the main drawer slides in by turns, in the same manner as the double drawer 400 slides out. When the main drawer 460 completely slides in and is thus returned to its initial position shown in FIG. 8, the drawer chamber 300 is closed by pushing the aforementioned drawer door 320 (see FIG. 3).

In the meantime, in order to disassemble the double drawer 400 for cleaning or other reasons, the auxiliary drawer 440 in which the main drawer 460 is seated is dismounted from the open front portions of the guide rails 420 by lifting the auxiliary drawer 440 and simultaneously pulling it forward.

Next, by lifting the main drawer 460 after the first rolling members 462 are positioned at the rear ends of the drawing rails 450 by pushing the main drawer 460 to the rear of the auxiliary drawer 440, the first rolling members 462 are pulled out of the open portions of the drawing rails 450 and then the main drawer 460 is disassembled. In order to intend the disassembled double drawer 400 to be mounted again, the double drawer 400 is assembled in reverse order of the disassembly.

Figure 12:
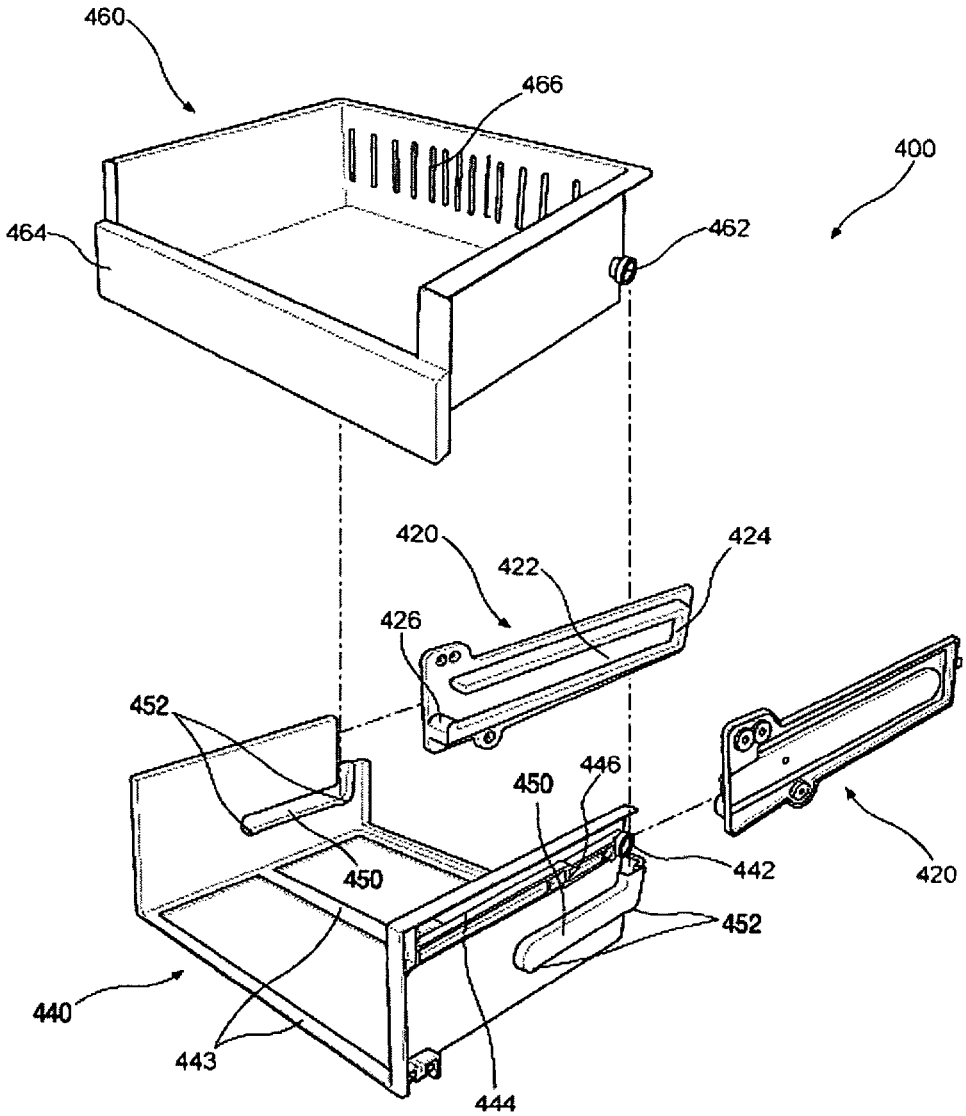
FIG. 12 is an exploded perspective view showing a refrigerator double drawer according to a second embodiment of the present invention.
Figure 13:
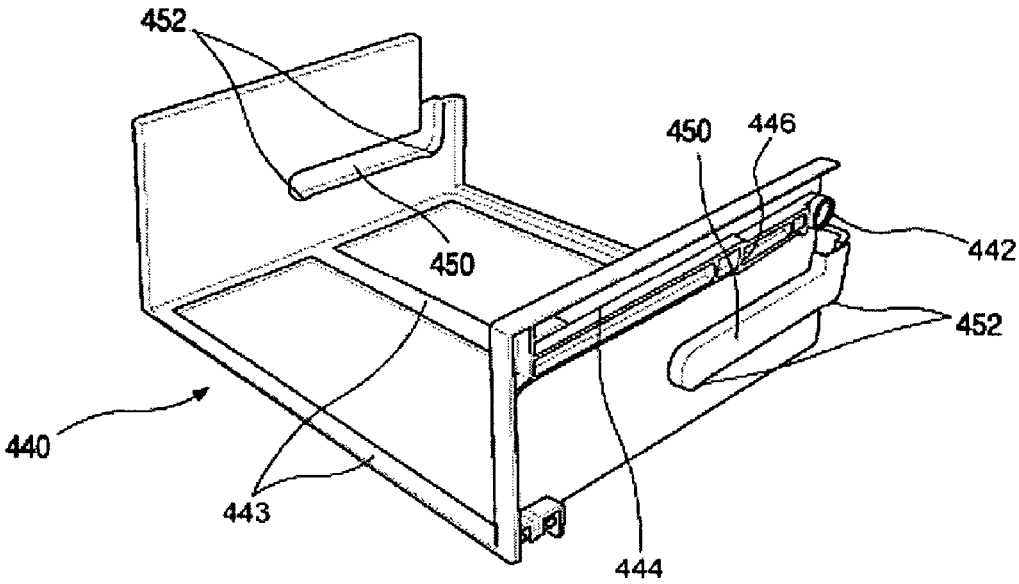
FIG. 13 is a perspective view separately showing an auxiliary drawer separated from the refrigerator double drawer shown in FIG. 12.
Figure 14:
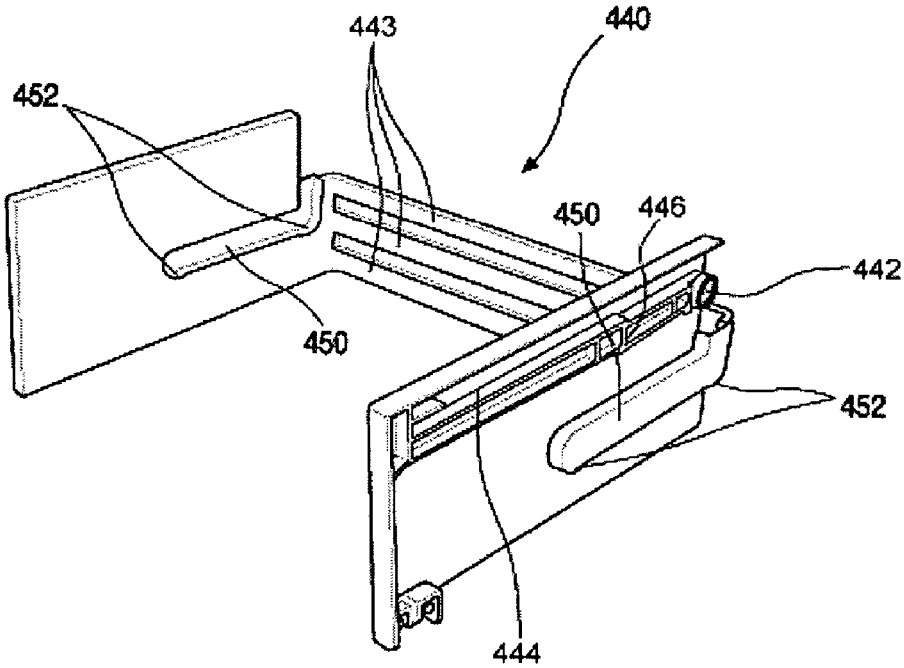
FIG. 14 is a perspective view showing a modified embodiment in which the configuration of the auxiliary drawer of the refrigerator double drawer shown in FIGS. 12 and 13 is changed.
Figure 15:
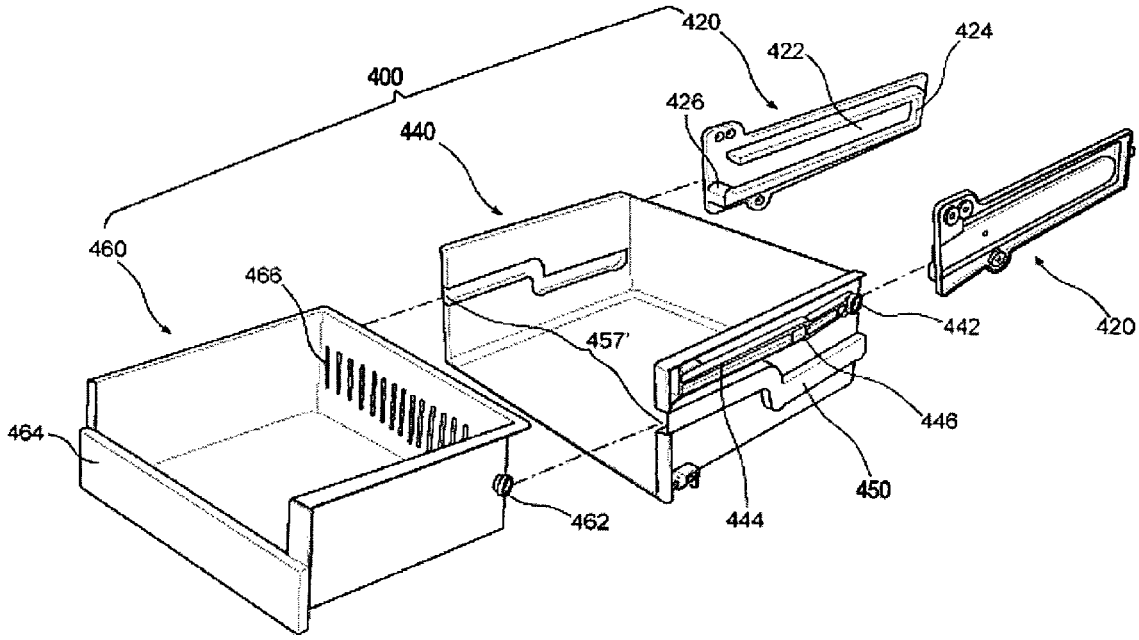
FIG. 15 is an exploded perspective view showing a refrigerator double drawer according to a third embodiment of the present invention in which a main drawer can be mounted from a front end of an auxiliary drawer.
Figure 16:
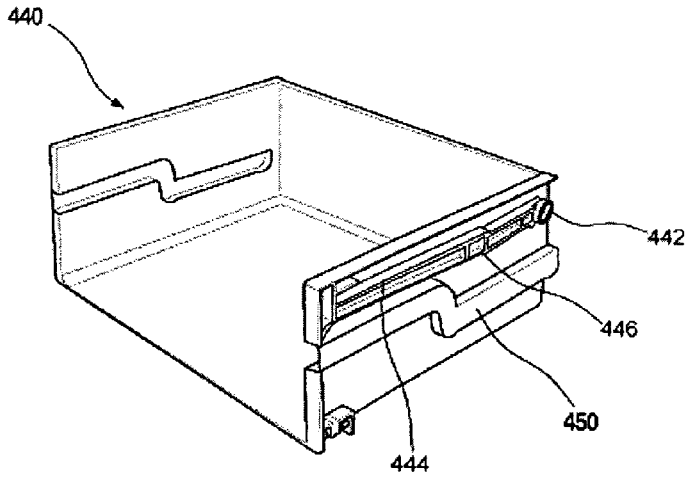
FIG. 16 is a perspective view separately showing the auxiliary drawer separated from the refrigerator double drawer shown in FIG. 15.
Figure 17:
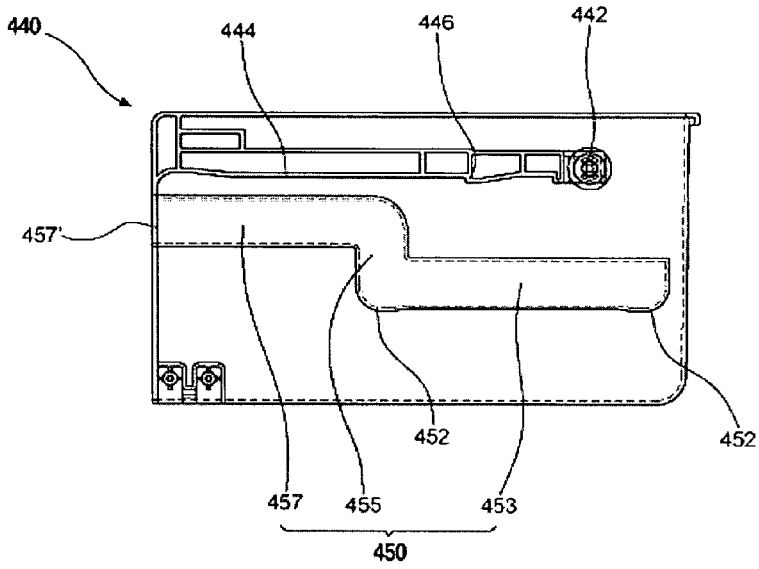
FIGS. 17 and 18 are sectional views for explaining the operation of the refrigerator double drawer shown in FIGS. 15 and FIG. 16.

FIGS. 12 to 14 are views showing a refrigerator double drawer 400 according to a second embodiment of the present invention with an auxiliary drawer 440 lightened.

Referring to FIGS. 12 and 13, the auxiliary drawer 440 has a width larger than the main drawer 460 and thus the main drawer 460 is accommodated in the auxiliary drawer 440, while both the side surfaces of the auxiliary drawer 440 face the guide rails 420. In the same manner as the previous embodiment, since the front face of the auxiliary drawer 440 is completely opened, the main drawer 460 seated in the auxiliary drawer 440 is caused to slide smoothly forward. Since the upper and rear faces of the auxiliary drawer 440 are also opened, the main drawer 460 is caused to be downward mounted in the auxiliary drawer 440.

Contrary to the previous embodiment, however, the auxiliary drawer 440 of the present embodiment is formed so that a considerable portion of its bottom face is opened. The open portion of the bottom face of the auxiliary drawer 440 is formed with connection portions 443 which connect both side walls of the auxiliary drawer 440 to each other. The connection portions 443 are formed to horizontally traverse the bottom face of the auxiliary drawer 440 and support both the side walls of the auxiliary drawer 440 by connecting the lower ends of both the side walls of the auxiliary drawer 440 to each other.

Therefore, the connection portions 443 cause the auxiliary drawer 440 to be lightened in configuration, and the friction between the main drawer 460 and the bottom face of the auxiliary drawer 440 can be minimized when the main drawer 460 slides in and out. One or more connection portions 443 may be formed, if desired, and a width of each connection portion can be diversely changed according to conditions.

FIG. 14 shows an auxiliary drawer 440 according to a modification to the embodiment shown in FIGS. 12 and 13. As shown in FIG. 14, the auxiliary drawer 440 of the modification has the same configuration of both the side walls as the auxiliary drawer of the previous embodiment. However, the auxiliary drawer 440 is configured so that the bottom face as well as the front and upper faces thereof is opened and both the side walls of the auxiliary drawer 440 are connected to each other through connection portions 443 formed in the rear face of the auxiliary drawer 440. Therefore, both the side walls of the auxiliary drawer 440 are supported by the connection portions 443 and maintain the configuration of the auxiliary drawer 440 for the main drawer 460 to slide stably in the auxiliary drawer 440.

FIGS. 15 to 18 are views showing a refrigerator double drawer according to a third embodiment of the present invention in which a main drawer is inserted into an auxiliary drawer from the front thereof and slides. As shown in FIGS. 15 to 18, the refrigerator double drawer of the present embodiment comprises guide rails 420, an auxiliary drawer 440, and a main drawer 460 in the same manner as the previous embodiments.

Referring to FIGS. 15 to 18, drawing rails 450 are formed on both side walls of the auxiliary drawer. The drawing rails 450, which first rolling members 462 provided on both side surfaces of the main drawer 460 are in contact with and roll in, are formed by allowing portions of the auxiliary drawer 440 to be depressed from the inside to the outside thereof by a predetermined depth.

Each of the drawing rails 450 is formed to extend from a rear end of the auxiliary drawer 440 to a front end of the auxiliary drawer 440 and is formed stepwise so that a bottom surface of an upper step portion thereof is positioned above a bottom surface of a lower step portion thereof.

In addition, in order to receive the first rolling members 462, the drawing rails 450 are formed at positions corresponding to the first rolling members 462 when the main drawer 460 is seated in the auxiliary drawer 440.

The drawing rail 450 comprises a movable portion 453 for guiding the movement of the first rolling member 462, a vertical portion 455 functioning as a catching portion for catching the first rolling member 462, and an insertion portion 457 in which the first rolling member 462 is inserted.

The movable portion 453 is formed to extend in parallel with the bottom surface of the auxiliary drawer 440 from the rear end to the middle portion of the auxiliary drawer 440 and to have depth and width sufficient for the first rolling member 462 to move smoothly.

Seating portions 452 are formed in both side ends of the movable portion 453. The seating portions 452, in which the first rolling member 462 is seated when the main drawer 460 completely slides out forward from the inside of the auxiliary drawer 440 or completely slides in rearward, are formed to be depressed with a predetermined curvature.

The vertical portion 455 is formed to vertically extend upward at the front end of the movable portion 453. The vertical portion 455 functions as a catching portion which prevents the first rolling member 462 from escaping out of the movable portion 453 when the main drawer 460 slides out. It is preferred that an extended height of the vertical portion 455 be at least larger than a radius of the first rolling member 462.

The insertion portion 457 is formed at the upper end of the vertical portion 455 which is formed to extend by the predetermined height. The insertion portion 457, which is a passage for insertion of the first rolling member 462, is formed to extend from the upper end of the vertical portion 455 to the front end of the auxiliary drawer 440.

In addition, the front end of the insertion portion 457 is opened to the front, so that a rolling member insertion opening 457' is defined, into which the first rolling member 462 can be inserted when the main drawer 460 is seated in the auxiliary drawer 440.

The rolling member insertion opening 457' is opened to be somewhat larger than a diameter of the first rolling member 462. Thus, the main drawer 460 is seated in the auxiliary drawer 440 by inserting the first rolling members 462 into the insertion portions 457 of the drawing rails 450 through the rolling member insertion openings 457'.

In the meantime, second rolling members 442 are provided on both side surfaces of the auxiliary drawer 440 to which the drawing rails 450 are mounted. The second rolling members 442, which cause the auxiliary drawer 440 to slide along guide rails 420, which will be described below, have the same configuration as the first rolling members 462.

The second rolling members 442 are mounted on upper rear portions of both the side surfaces of the auxiliary drawer 440, i.e., above the drawing rails 450, respectively. In addition, sliding guides 444 are formed to extend from the positions, in which the second rolling members 442 are mounted, to the front ends of the auxiliary drawer 440.

The sliding guides 444, which serve to prevent the auxiliary drawer 440 from sagging when the auxiliary drawer 440 slides in and out, are formed to protrude outward with a predetermined width. Guide catching portions 446 are formed on the rear portions of the sliding guides 444, more particularly, adjacent to the positions in which the second rolling members 442 are mounted.

The guide catching portions 446 are brought into contact with rail catching portions 426 formed on the guide rails 420 and then limit the sliding motion of the auxiliary drawer 440, so that the auxiliary drawer 440 cannot come off due to an excessive pulling action when the auxiliary drawer 440 slides out. To this end, each guide catching portion 446 is formed to protrude in a hook shape on the lower portion of each sliding guide 444.

In the meantime, the auxiliary drawer 440 is mounted to the guide rails 420. The guide rails 420, which serve to guide the slide of the auxiliary drawer 440, are installed on the left and light sides of the refrigerator main body 100 (see FIG. 3), more particularly, on the left and light side surfaces of the upper portion of the drawer chamber 300.

Each of the guide rails 420 is formed in an elongated quadrangular plate shape. A protrusion 424 and a receiving portion 422 are formed on the middle portion of each guide rail 420 to extend along the longitudinal direction of the guide rail 420.

The protrusion 424 is formed along the peripheral portion of the guide rail 420 to protrude inward by a predetermined distance with a predetermined width. Therefore, the receiving portion 422 is naturally formed to be depressed in the inside of the portion in which the protrusion 424 is formed. The configuration of the receiving portion 422 is determined according to the protrusion 424.

The receiving portion 422, which the second rolling member 442 is in contact with and rolls in, is formed with a predetermined width so that the second rolling member 442 stably rolls and moves.

In addition, the protrusion 424 is formed to have a front upper corner opened. The rail catching portion 426 is formed at the front end of the lower portion of the protrusion 424. The rail catching portions 426 are brought into contact with the guide catching portions 446 formed on the sliding guides 444 and prevent the auxiliary drawer 440 from sliding out excessively. Each rail catching portion 426 is formed to protrude upward in a hook shape like the guide catching portion 446.

Hereinafter, the operation of the double drawer 400 of a refrigerator according to the present invention so configured will be described.

Figure 18:
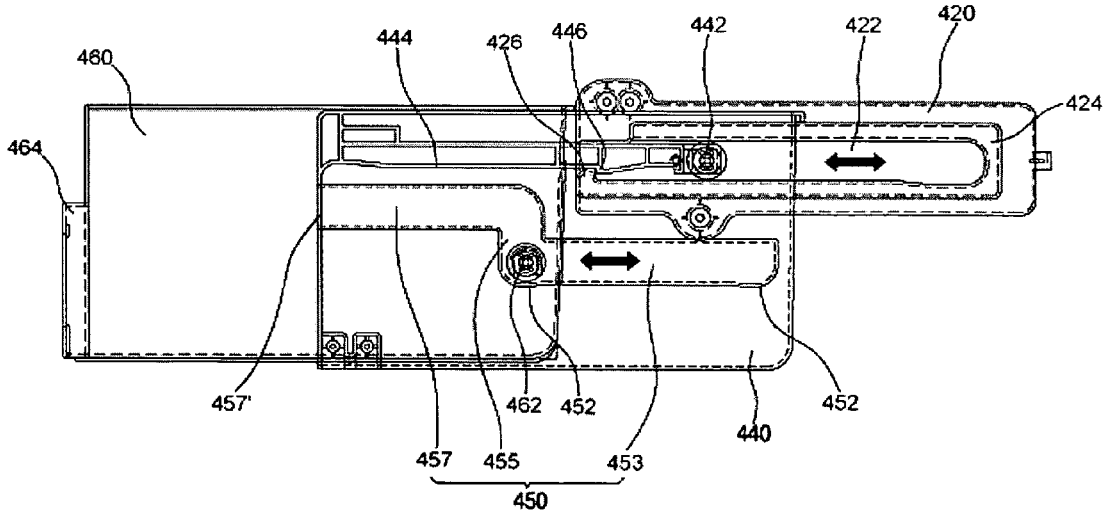

FIG. 18 is a schematic view illustrating the operation of the aforementioned refrigerator double drawer. Referring to the figure, in a state where the double drawer 400 is completely accommodated in the refrigerator, the first rolling members 462 of the main drawer 460 are seated in the drawing rails 450, more particularly, in the seating portions 452 at the rear ends of the movable portions 453 of the drawing rails 450, and the second rolling members 442 of the auxiliary drawer 440 are positioned at the rear ends of the guide rails 420.

In order to pull the double drawer 400, when the front plate 464 formed on the front of the main drawer 460 is gripped and pulled forward, the auxiliary drawer 440 first slides out forward.

At this time, the main drawer 460 does not slide out before the auxiliary drawer 440. It is the reason why the first rolling members 462 causing the main drawer 460 to slide are seated in the seating portions 452 at the rear ends of the movable portions 453 and a predetermined force is required to cause the first rolling members 462 to go over the seating portions 452 and move.

On the other hand, the second rolling members 442 that allows the auxiliary drawer 440 to slide are positioned at the rear ends of the receiving portions 422 of the guide rails 420. Further, although the rear ends of the receiving portions 422 are somewhat inclined, the second rolling members 442 can go over the inclinations with a force smaller than a force needed for allowing the first rolling members 462 to go over the seating portions 452. Thus, the auxiliary drawer 440 first slides out.

When the guide catching portions 446 come into contact with the rail catching portions 426 after the auxiliary drawer 440 slides out to a certain extent, the auxiliary drawer 440 does not slides out any longer. When a force for pulling the main drawer 460 forward becomes larger than that for causing the first rolling members 462 to go over the seating portions 452 by continuously pulling the front plate 464, the first rolling members 462 go over the seating portions 452 and then move along the movable portions 453.

The movement of the first rolling members 462 causes the main drawer 460 to slide out forward from the inside of the auxiliary drawer 440 while the first rolling members 462 are guided by the movable portions 453. When the first rolling members 462 are positioned at the seating portions 452 in the front ends of the movable portions 453, the main drawer 460 no more slides out.

In the meantime, upon review of the process of sliding in the double drawer 400, when the front plate 464 of the main drawer 460 is pushed rearward, the seating portions 452 at the front ends of the movable portions 453 cause the second rolling members 442 mounted to the auxiliary drawer 440 to roll and move first in the same manner as the double drawer 400 slides out.

When the movement of the second rolling members 442 is completed, the first rolling members 462 go over the seating portions 452 and move rearward along the movable portions 453. Thus, the main drawer 460 slides in rearward. When the main drawer 460 completely slides in, the double drawer 400 is returned to its initial position before it slides out.

In the meantime, when services of the double drawer 400 are needed or the main drawer 460 in which foods are accommodated is necessary to be disassembled together during use of the double drawer 400, the front plate 464 is pulled out through the aforementioned pulling process so that the main drawer 460 moves to the front ends of the movable portions 453.

Then, in order for the first rolling members 462 to pass over the vertical portions 455, if the first rolling members 462 are positioned at the rear ends of the insertion portions 457 after the main drawer 460 is lifted by a predetermined height, the main drawer 460 is separated from the auxiliary drawer 440 by pulling the main drawer 460 forward again to pass through the rolling member insertion openings 457'.

In order to mount the separated main drawer 460 to the auxiliary drawer 440, in reverse order of the disassembly, by inserting the first rolling members 462 into the rolling member insertion openings 457', allowing the first rolling members 462 to pass through the insertion portions 457 and the vertical portions 455, and then causing the double drawer 400 to slide in, the double drawer 400 is assembled to its initial state.

The refrigerator double drawer 400 of the aforementioned present embodiment, when the double drawer is intended to be cleaned or managed or the main drawer, in which foods are accommodated, is intended to be pulled out at a time, there are advantages in that it is possible to easily separate the main drawer 460 through the front of the auxiliary drawer 440 as well as to easily assemble the main drawer 460 by inserting it through the front of the auxiliary drawer 440 even when mounting the main drawer 460 after separating it, thus causing the user to conveniently use the main drawer 460.

Figure 19:
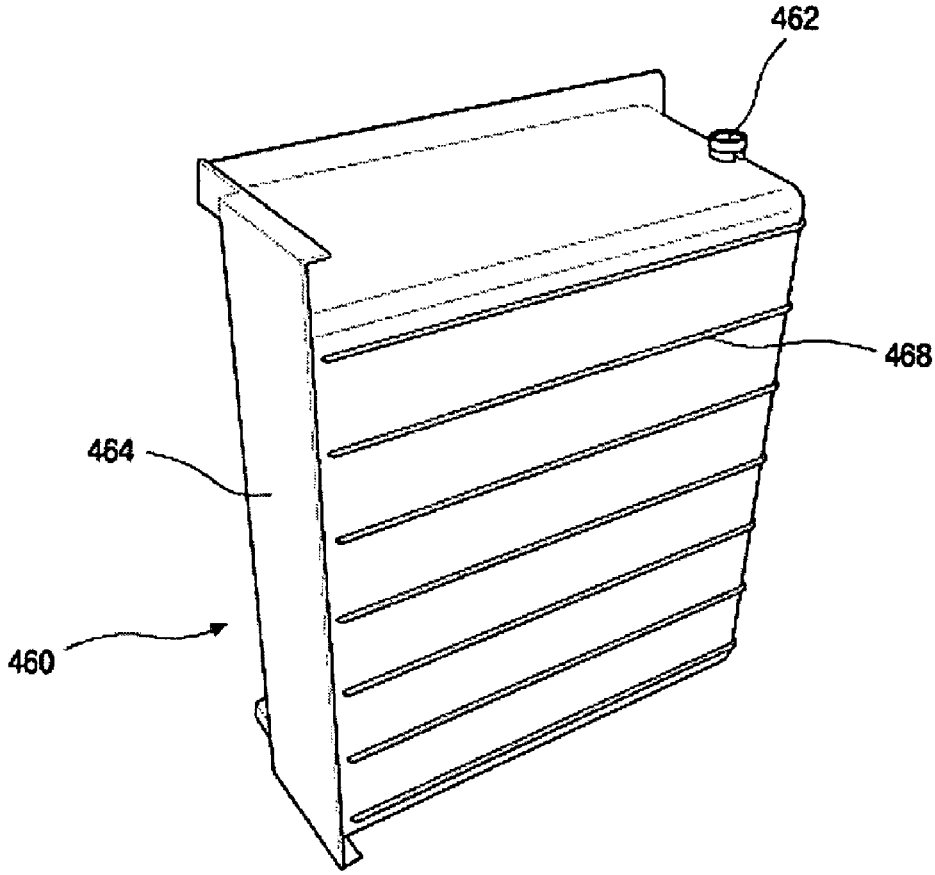
FIG. 19 is a perspective view showing the bottom of a main drawer separated from a refrigerator double drawer according to a fourth embodiment of the present invention.

FIG. 19 is a perspective view showing a bottom of a main drawer 460 according to a fourth embodiment of the present invention in order to explain the main drawer 460 the strength of which is considerably improved. As shown in FIG. 19, reinforcing ribs 468 for strengthening the main drawer 460 is formed on the bottom surface of the main drawer 460. The reinforcing ribs 468 are formed to protrude downward from the bottom surface of the main drawer 460 by a predetermined height, wherein the forming direction is determined to be in the fore and aft direction of the main drawer 460. Furthermore, the reinforcing ribs 468 are preferably formed to be arranged from side to side at equi-intervals. In the storage space of the auxiliary drawer 440 (see FIGS. 4 to 18), lower ends of the reinforcing ribs 468 comes into contact with the inner surface of the auxiliary drawer 440.

Figure 20:
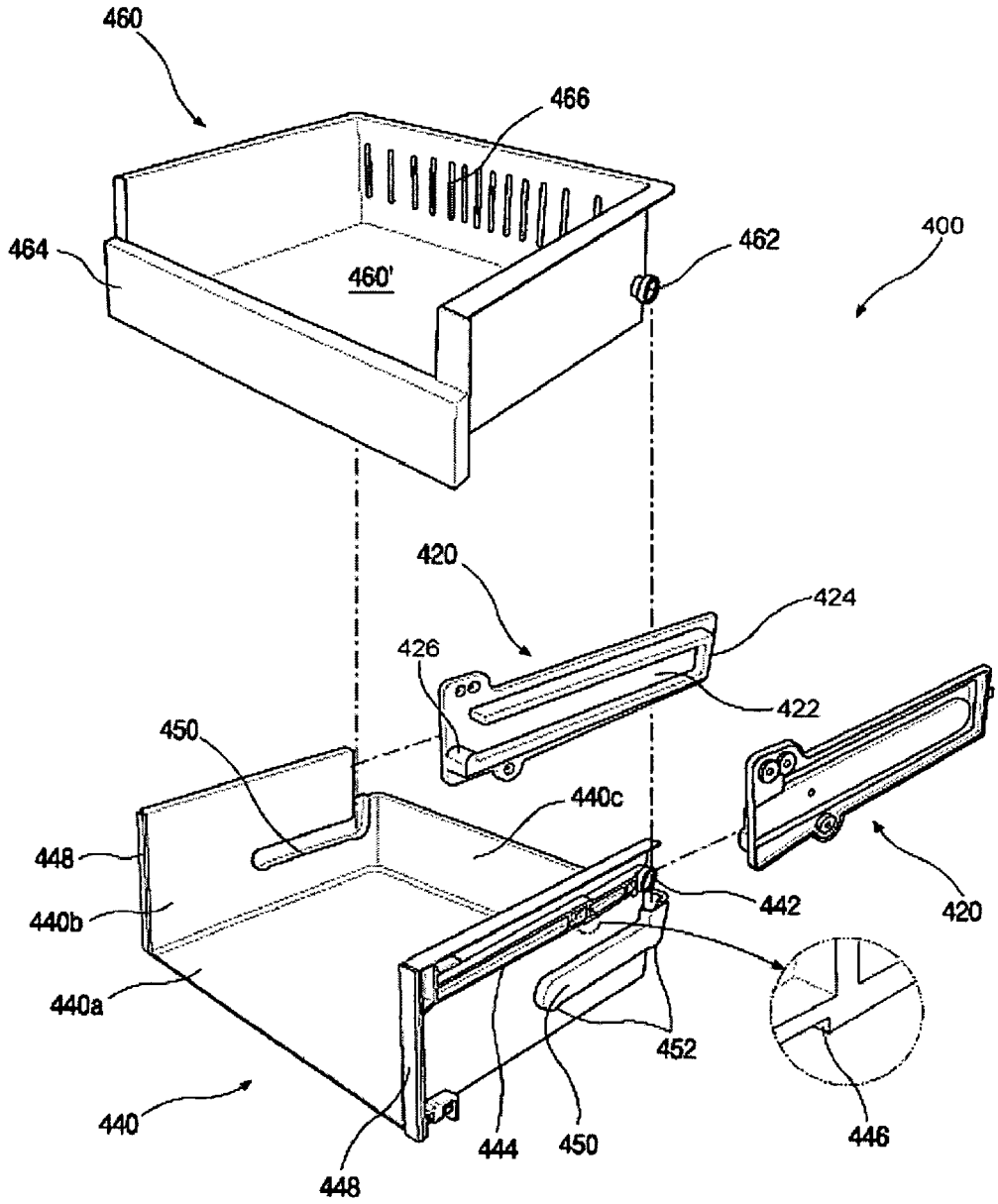
FIG. 20 is an exploded perspective view showing a refrigerator double drawer according to a fifth embodiment of the present invention which has a configuration for mitigating collision between an auxiliary drawer and a main drawer.
Figure 21:
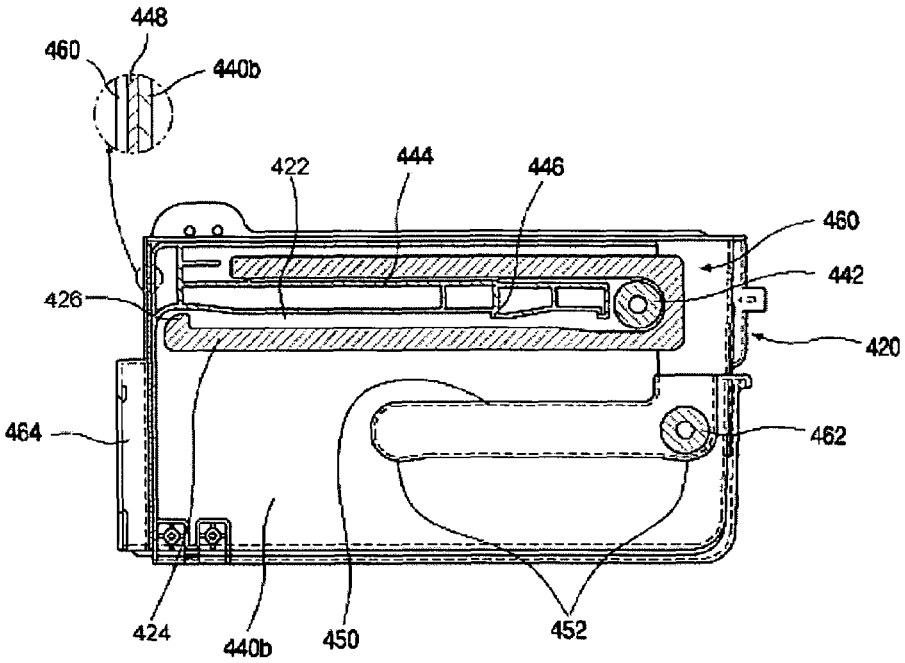
FIGS. 21 and 22 are sectional views for explaining the operation of the refrigerator double drawer shown in FIG. 20.
Figure 22:
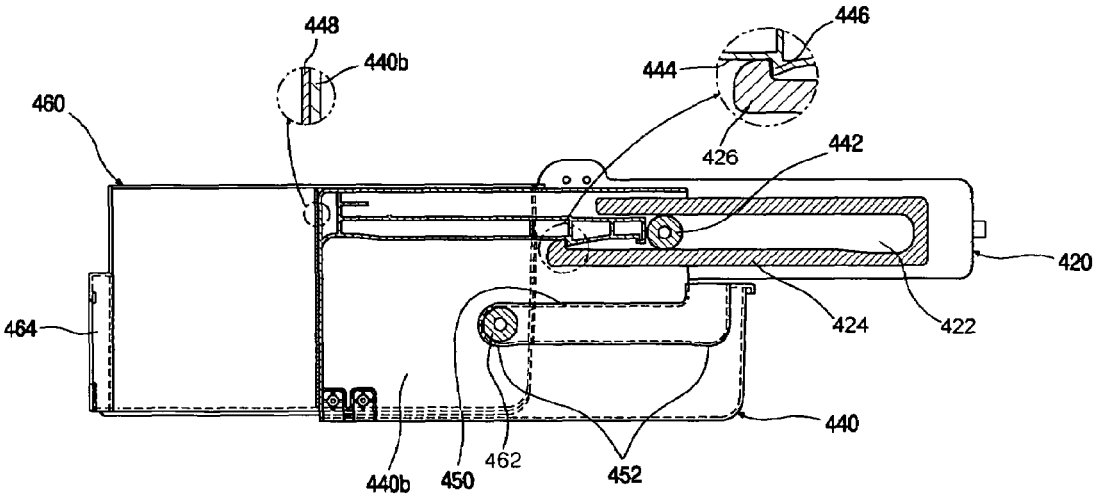

FIGS. 20 to 22 are views for explaining a refrigerator double drawer according to a fifth embodiment of the present invention, which has a configuration for mitigating collision between an auxiliary drawer and a main drawer and shock and noise caused therefrom.

As shown in FIGS. 20 to 22, a refrigerator double drawer 400 of the present embodiment is provided with shock absorbing members 448 at the front ends of the auxiliary drawer 440. The shock absorbing members 448 mitigate collision between the main drawer 460 and the auxiliary drawer 440 and the shock caused therefrom.

In the present embodiment, the shock absorbing members 448 are attached to the front ends of side walls 440*b* of the auxiliary drawer 440, and thus serve to mitigate the shock when the double drawer 400 is opened and closed and accordingly the main drawer 460 and the auxiliary drawer 440 collide. It is preferred that the shock absorbing member 448 be formed of elastic material such as rubber.

In the double drawer 400 of the present embodiment, simultaneously when or successively after the main drawer 460 slides out forward, the auxiliary drawer 440 also slides out forward by means of the guide rails 420. A state where the main drawer 460 and the auxiliary drawer 440 completely slide out is shown in FIG. 22.

When the main drawer 460 and the auxiliary drawer 440 slide out forward as described above, the user accommodates foods in an accommodating space 460' of the main drawer 460 or takes out the accommodated food.

Next, in order to push the main drawer 460 into the refrigerator, a force is exerted to the front plate 464 rearward. Thus, the main drawer 460 and the auxiliary drawer 440 simultaneously or successively move back and finally become into a state shown in FIG. 21

At this time, the shock absorbing members 448 mitigate the collision between the main drawer 460 and the auxiliary drawer 440 and the shock caused therefrom. That is, when the main drawer 460 moves back rapidly and the main drawer 460 collides against the auxiliary drawer 440, the shock absorbing members 448 attached to the front ends of the side walls 440*b* of the auxiliary drawer 440 collides against the main drawer 460 thus mitigating the shock.

In the present embodiment, the rubber is illustrated as the shock absorbing member 448. However, other materials serving to mitigate shock may be used as the shock absorbing member 448. Further, it is described in the foregoing that the shock absorbing members 448 are provided on the front ends of the side walls 440*b* of the auxiliary drawer 440. However, the installation positions of the shock absorbing members 448 may be diversely changed. That is, the shock absorbing members 448 may be attached to a front end of a bottom wall 440*a* of the auxiliary drawer 440 or to rear sides of the front end of the main drawer 460 (i.e., the portions brought into contact with the front end of the auxiliary drawer).

Each of the shock absorbing members 448 is formed as one piece to vertically extend on the front end of each of the side walls 440*b* of the auxiliary drawer 440 as described in the aforementioned embodiment. Alternatively, the shock absorbing member 448 may be provided only on an upper portion of the front end of each side wall 440*b* of the auxiliary drawer 440, or a plurality of members into which the shock absorbing member 448 is separated are provided on the upper, lower, and middle portions of the front end of each side wall.

Figure 23:
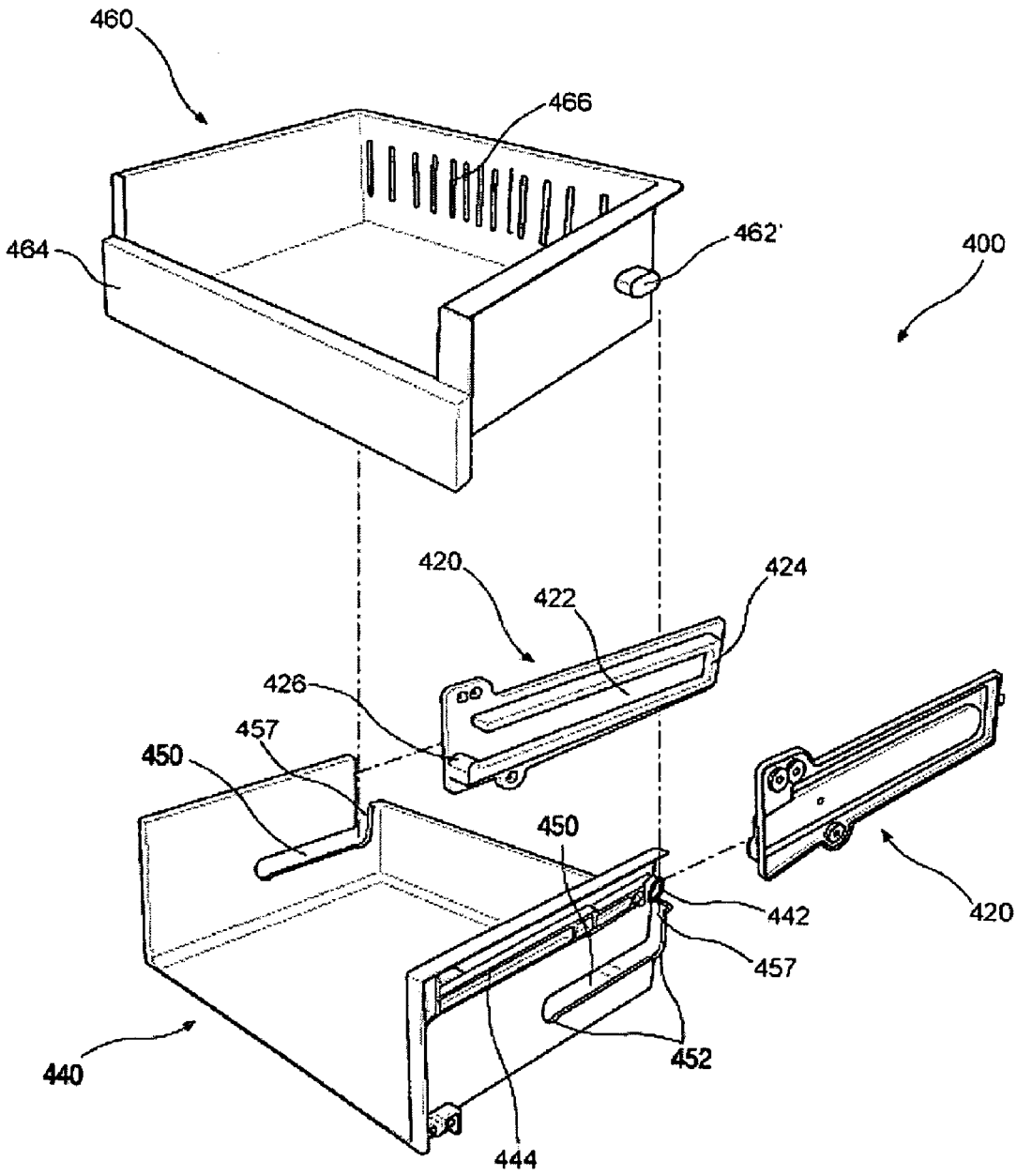
FIG. 23 is an exploded perspective view showing a refrigerator double drawer according to a sixth embodiment of the present invention.
Figure 24:
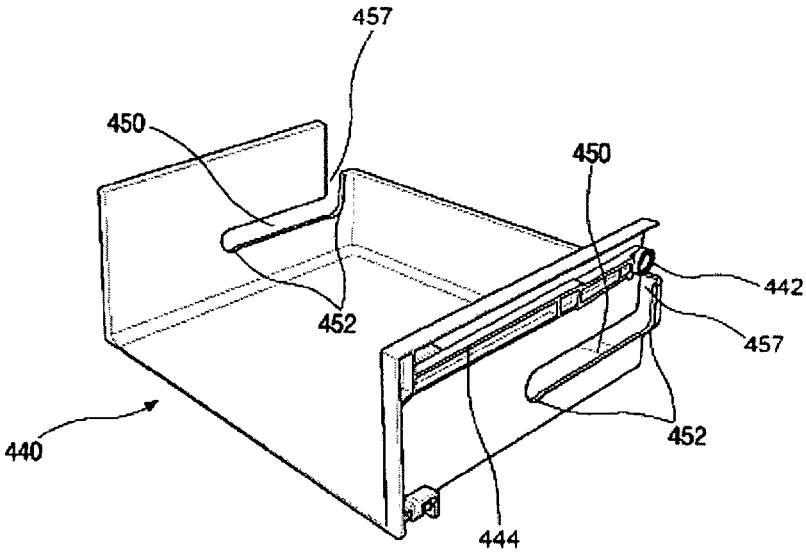
FIG. 24 is a perspective view showing an auxiliary drawer separated from the refrigerator double drawer shown in FIG. 23.
Figure 25:
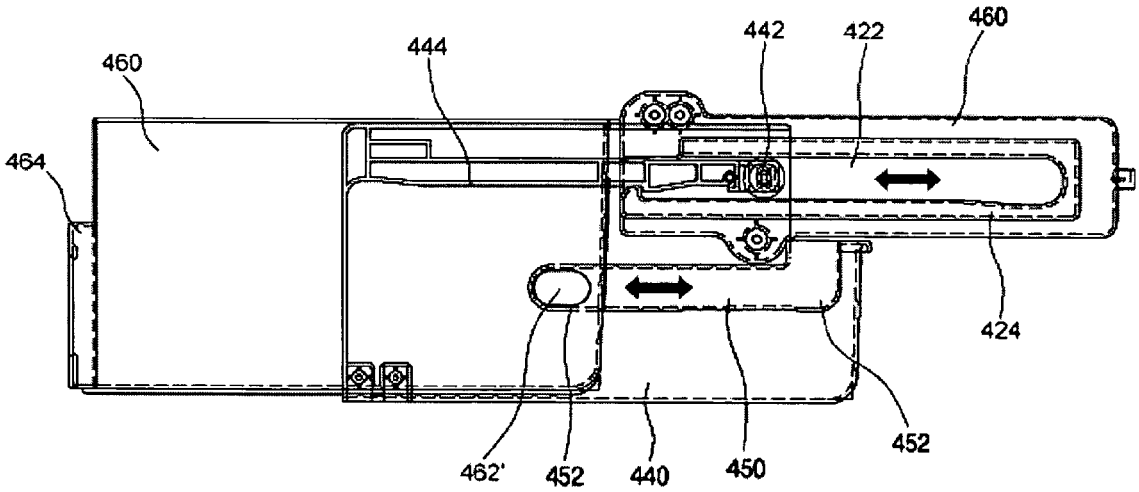
FIG. 25 is a sectional view for explaining the operation of the refrigerator double drawer shown in FIGS. 23 and 24.

FIGS. 23 to 25 are views illustrating a refrigerator double drawer according to a sixth embodiment of the present invention. Referring to FIGS. 23 to 25, a double drawer 400 according to the present embodiment will be described below.

In the present embodiment, sliding members 462' are provided on both side surfaces of the main drawer 460, respectively. The sliding members 462', which cause the main drawer 460 to slide smoothly, are formed on rear ends of both the side surfaces of the main drawer 460.

The sliding members 462' are formed on the rear ends of both the side surfaces of the main drawer 460, more particularly, at positions corresponding to opening type drawing rails 450, which will be described below. The sliding members 462' are also formed to protrude vertically from both the side surfaces of the main drawer 460 by a predetermined distance.

The sliding members 462' are formed to have predetermined thickness and width so as to support the weight of the main drawer 460 and foods accommodated therein. The configuration of each sliding member 462' may be diversely modified. In the same manner as the previous embodiment, the main drawer 460 is seated in the auxiliary drawer 440 and slides in and out in the fore and aft direction in the auxiliary drawer 440.

The auxiliary drawer 440 is formed in a box shape as a whole and larger than the main drawer 460 so that the main drawer 460 is seated in auxiliary drawer 440. In addition, the front face of the auxiliary drawer 440 is fully opened, so that the main drawer 460 seated in the auxiliary drawer 440 is caused to easily slide forward. The upper face of the auxiliary drawer 440 is also opened, thus making it easy to check the inside of the main drawer 460 and the food accommodated therein.

The opening type drawing rails 450 are formed in both side walls of the auxiliary drawer 440. The drawing rails 450, which guide the slide of the sliding members 462' formed on both side surfaces of the main drawer 460, are formed in positions corresponding to the sliding members 462' so as to receive the sliding members 462' when the main drawer 460 is seated in the auxiliary drawer 440.

In detail, the drawing rails 450 are formed to extend from the rear ends of both the side walls of the auxiliary drawer 440 at least up to the middle portions thereof and to be bored through both the side walls of the auxiliary drawer 440.

An insertion portion 457 is formed in the rear end of each drawing rail 450. The insertion portion 457, which is an insertion passage of the sliding member 462', is formed to be opened upward at the rear end of the drawing rail 450.

Therefore, the main drawer 460 can be securely seated in the auxiliary drawer 440 merely by positioning the sliding members 462' formed on both the side surfaces of the main drawer 460 to the insertion portions 457 of the auxiliary drawer 440 and inserting the main drawer 460 into the opening type drawing rails 450.

The sliding members 462' slide on lower surfaces of the opening type drawing rails 450. Seating portions 452 are formed in both ends of each of the drawing rails 450. The seating portions 452, which function as catching portions against the sliding members 462', are formed to be depressed to be somewhat larger than the sliding members 462' and to have a shape similar to the sliding members 462'.

The sliding members 462' sliding along the lower surfaces of the drawing rails 450 are seated in the seating portions 452 of both the ends of the drawing rails 450, and stop sliding.

In the meantime, rolling members 442 are provided on both the side surfaces of the auxiliary drawer 440 on which the drawing rails 450 are provided. The rolling members 442 may roll along guide rails 420, which will be described below, such that the auxiliary drawer 440 can slide or be formed in a protrusion shape similar to the sliding member 462', if desired.

The rolling members 442 are mounted on upper rear portions of both the side surfaces of the auxiliary drawer 440, i.e., above the drawing rails 450, respectively. In addition, sliding guides 444 are formed to extend from the positions, in which the rolling members 442 are mounted, to the front ends of the auxiliary drawer 440.

The sliding guides 444, which serve to prevent the auxiliary drawer 440 from sagging downward when the auxiliary drawer 440 slides in and out, are formed to protrude outward with a predetermined width.

The auxiliary drawer 440 is mounted to the guide rails 420. The guide rails 420, which serve to guide the slide of the auxiliary drawer 440, are installed on the left and light sides of the refrigerator main body 100 (see FIG. 3), more particularly, on the left and light side surfaces of the upper portion of the drawer chamber 300.

Each of the guide rails 420 is formed in an elongated quadrangular plate shape. A protrusion 424 and a receiving portion 422 are formed on the middle portion of each guide rail 420 to extend along the longitudinal direction of the guide rail 420.

The protrusion 424 is formed along the peripheral portion of the guide rail 420 to protrude inward by a predetermined distance with a predetermined width. Therefore, the receiving portion 422 is naturally formed to be depressed in the inside of the portion in which the protrusion 424 is formed. The configuration of the receiving portion 422 is determined according to the protrusion 424.

The receiving portion 422, which the rolling member 442 is in contact with and rolls in, is formed with a predetermined width so that the rolling member 442 stably rolls and moves.

Hereinafter, the operation of the double drawer 400 of a refrigerator according to the present invention so configured will be described.

FIG. 25 is a schematic view showing the operation of the refrigerator double drawer according to the present embodiment. Referring to the figure, in a state where the double drawer 400 is completely accommodated in the refrigerator, the sliding members 462' of the main drawer 460 are seated in the seating portions 452 at the rear ends of the opening type drawing rails 450, and the rolling members 442 of the auxiliary drawer 440 are positioned at the rear ends of the guide rails 420.

In order to pull the double drawer 400, when the front plate 464 formed on the front of the main drawer 460 is gripped and pulled forward, the auxiliary drawer 440 first slides out forward.

At this time, the main drawer 460 does not slide out before the auxiliary drawer 440. It is the reason why the sliding members 462' causing the main drawer 460 to slide in and out are seated in the seating portions 452 at the rear ends of the opening type drawing rails 450 and a predetermined force is required to cause the sliding members 462' to go over the seating portions 452 and move.

On the other hand, the second rolling members 442 that allows the auxiliary drawer 440 to slide are positioned at the rear ends of the receiving portions 422 of the guide rails 420. Further, although the rear ends of the receiving portions 422 are somewhat inclined, the second rolling members 442 can go over the inclinations with a force smaller than a force needed for allowing the first rolling members 462' to go over the seating portions 452. Thus, the auxiliary drawer 440 first slides out.

When the front plate 464 is pulled continuously until the auxiliary drawer 440 no more slides out after the auxiliary drawer 440 slides out to a certain extent, a force for pulling the main drawer 460 forward becomes larger than that for causing the sliding members 462' to go over the seating portions 452.

Accordingly, the sliding members 462' go over the seating portions 452 and then slide along the lower ends of the drawing rails 450. The slide of the sliding members 462' causes the main drawer 460 to be pulled forward from the inside of the auxiliary drawer 440.

Then, when the sliding members 462' are positioned in the seating portions 452 at the front ends of the opening type drawing rails 450, the main drawer 460 no more slides out and thus the pulling of the main drawer 460 and auxiliary drawer 440 is completed.

In the meantime, upon review of the process of sliding in the double drawer 400, when the front plate 464 of the main drawer 460 is pushed rearward, the seating portions 452 at the front ends of the opening type drawing rails 450 cause the rolling members 442 mounted to the auxiliary drawer 440 to roll and move first in the same manner as the double drawer 400 slides out.

When the movement of the rolling members 442 is completed, the sliding members 462' go over the seating portions 452 and move rearward along the opening type drawing rails 450. Thus, the main drawer 460 slides in rearward. When the main drawer 460 completely slides in, the double drawer 400 is returned to its initial position before it slides out.

In addition, in a case where the double drawer 400 is necessary to be disassembled for cleaning or services, by lifting the main drawer 460 up when the main drawer 460 is completely accommodated in the auxiliary drawer 440, the sliding members 462' escape through the insertion portions 457 of the opening type drawing rails 450 and thus the main drawer 460 is separated from the auxiliary drawer 440.

Then, after completely sliding out along the guide rails 420, the auxiliary drawer 440 is lifted forward in the inclined direction of about 45 degrees, and thus, the auxiliary drawer 440 can be separated from the guide rails 420 through the opening portions of the protrusions 424.

When disassembling the double drawer, either of the auxiliary drawer 440 and the main drawer 460 can be first disassembled. The assembly process of the double drawer 400 is made in reverse order of the above disassembly process. Even at this time, any one of the auxiliary drawer 440 and the main drawer 460 may first be assembled regardless of the order.

Figure 26:
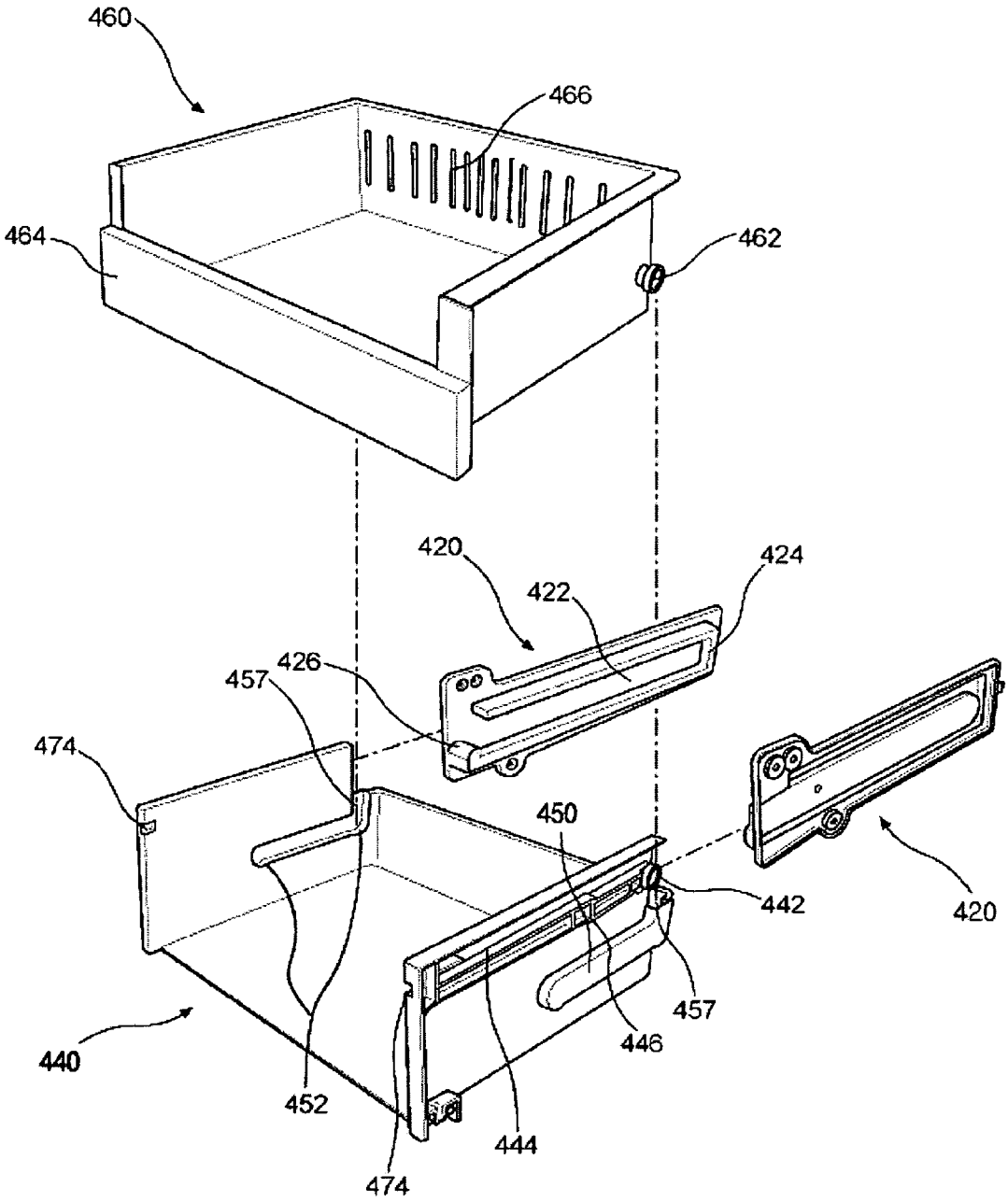
FIG. 26 is an exploded perspective view showing a refrigerator double drawer according to a seventh embodiment of the present invention.
Figure 27:
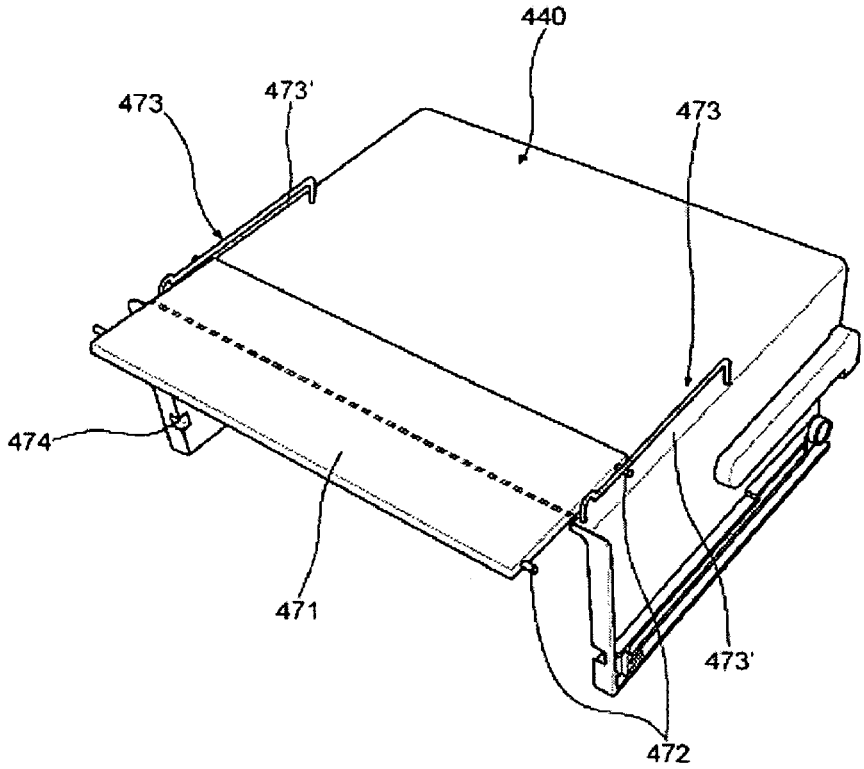
FIG. 27 is a perspective view showing a bottom of an auxiliary drawer separated from the refrigerator double drawer shown in FIG. 26.
Figure 28:
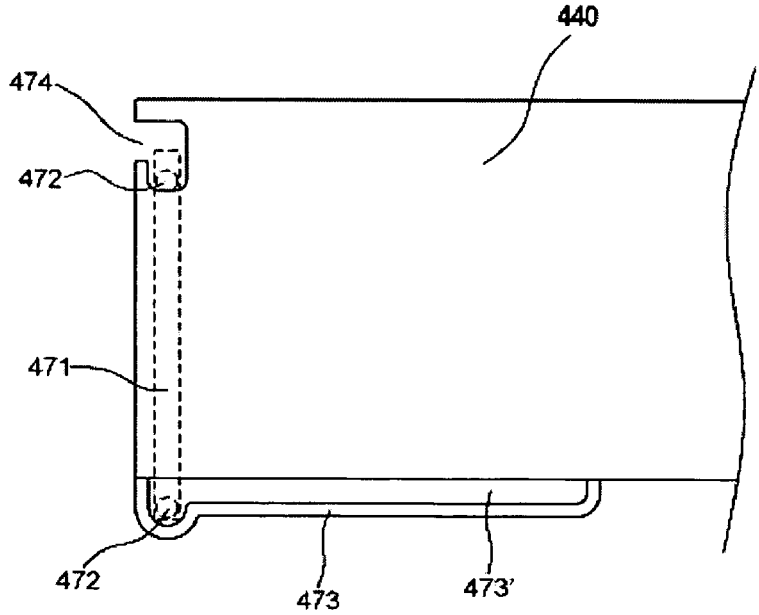
FIG. 28 is a partial side view showing the auxiliary drawer separated from the refrigerator double drawer shown in FIG. 26 wherein invisible portions are represented by dotted lines.

FIGS. 26 to 30 are views illustrating a refrigerator double drawer according to a seventh embodiment of the present invention. FIG. 26 is an exploded perspective view showing the major portions of the refrigerator double drawer; FIG. 27 is a perspective view showing a bottom of an auxiliary drawer of the refrigerator double drawer; and FIG. 28 is a side view of the auxiliary drawer.

As shown in FIGS. 27 and 28, an auxiliary drawer door 471 is mounted to a lower surface of an auxiliary drawer 440 according to the present embodiment. The auxiliary drawer door 471, which selectively opens and closes an open front face of the auxiliary drawer 440, is formed with a size to close the open face of the auxiliary drawer 440. Fixing protrusions 472 are formed to vertically protrude on upper and lower ends of both side surfaces of the auxiliary drawer door 471, respectively. The fixing protrusions 472 are mounted in door guides 473, which will be described below, and assist the auxiliary drawer 440 to be mounted, slide and pivot.

The door guides 473 are formed to vertically protrude on both side ends of the bottom surface of the auxiliary drawer 440 and to extend from front to rear end of the auxiliary drawer 440 by a height of the auxiliary drawer door 471.

Sliding holes 473' are defined between the bottom surface of the auxiliary drawer 440 and the door guides 473 to extend longitudinally from front to rear ends of the door guides 473 so that the fixing protrusions 472 formed on both the side surfaces of the auxiliary drawer door 471 are mounted and slide in the sliding holes 473'.

Therefore, when the auxiliary drawer 440 assists the main drawer 460 (see FIG. 26) to be guided with the main drawer 460 being seated in the auxiliary drawer 440, the auxiliary drawer door 471 is mounted on the bottom surface of the auxiliary drawer 440 in parallel therewith.

As shown in FIGS. 26 to 30, when the auxiliary drawer 440 is also used as an accommodating space with the main drawer 460 being separated from the auxiliary drawer 440, the auxiliary drawer door 471 selectively closes the open front face of the auxiliary drawer 440.

Further, in order to fix the auxiliary drawer door 471 to the front face of the auxiliary drawer 440, fixing grooves 474 are formed in the front ends of both side walls of the auxiliary drawer 440. The fixing grooves 474 are formed so that the fixing protrusions 472 formed on the upper ends of both the side surfaces of the auxiliary drawer door 471 are inserted into the fixing grooves 474 when the auxiliary drawer door 471 closes the front face of the auxiliary drawer 440.

In the meantime, the same auxiliary drawer 440 as employed in the previous embodiments is mounted to the guide rails 420. The guide rails 420, which are installed on the upper left and right side surfaces of the drawer chamber 300 to guide the slide of the auxiliary drawer 440, respectively, have been already described in the previous embodiments.

Figure 29:
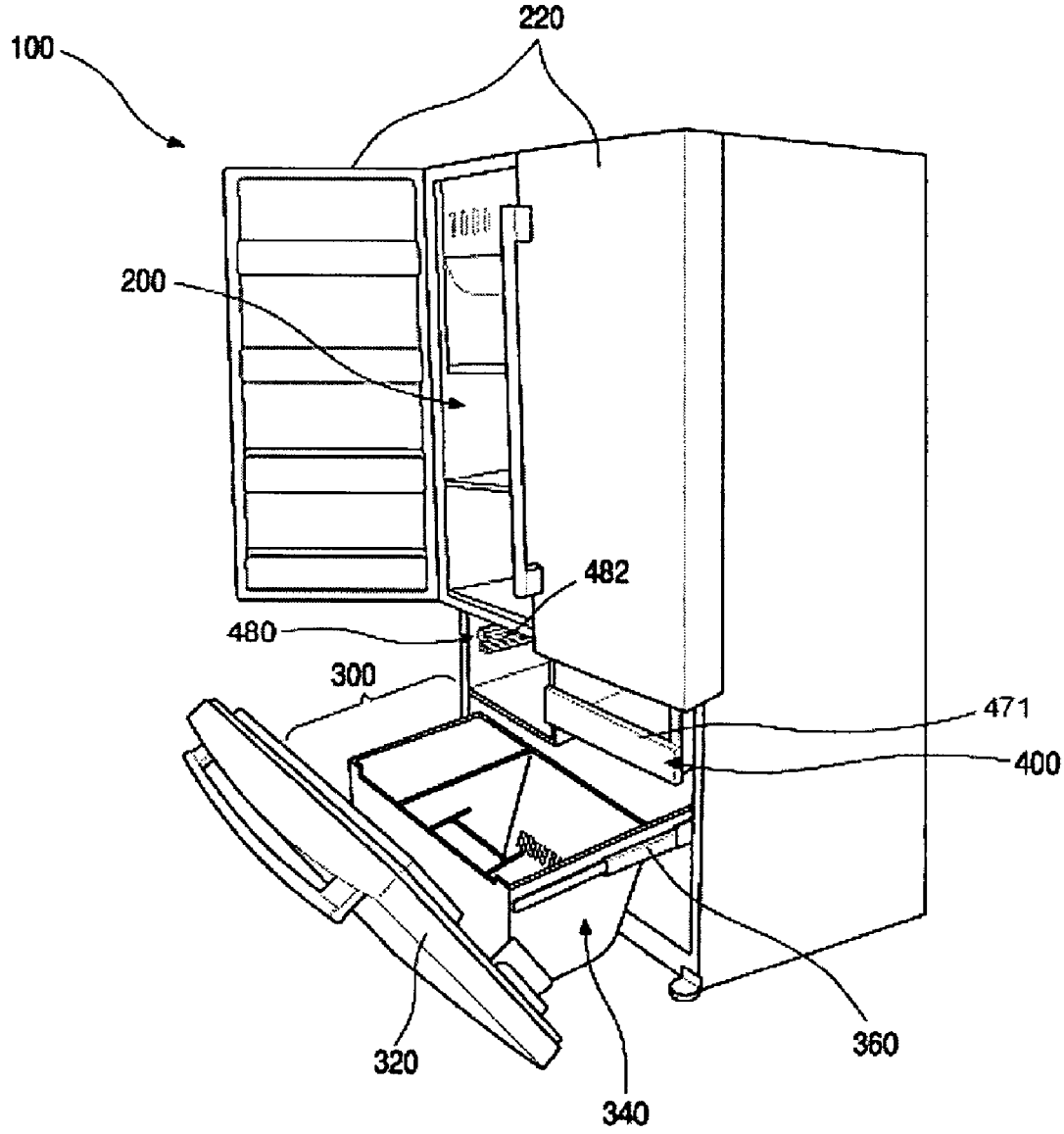
FIGS. 29 and 30 are perspective views showing a refrigerator in which the refrigerator double drawer shown in FIG. 26 is employed, wherein the auxiliary drawer is installed in different positions.
Figure 30:
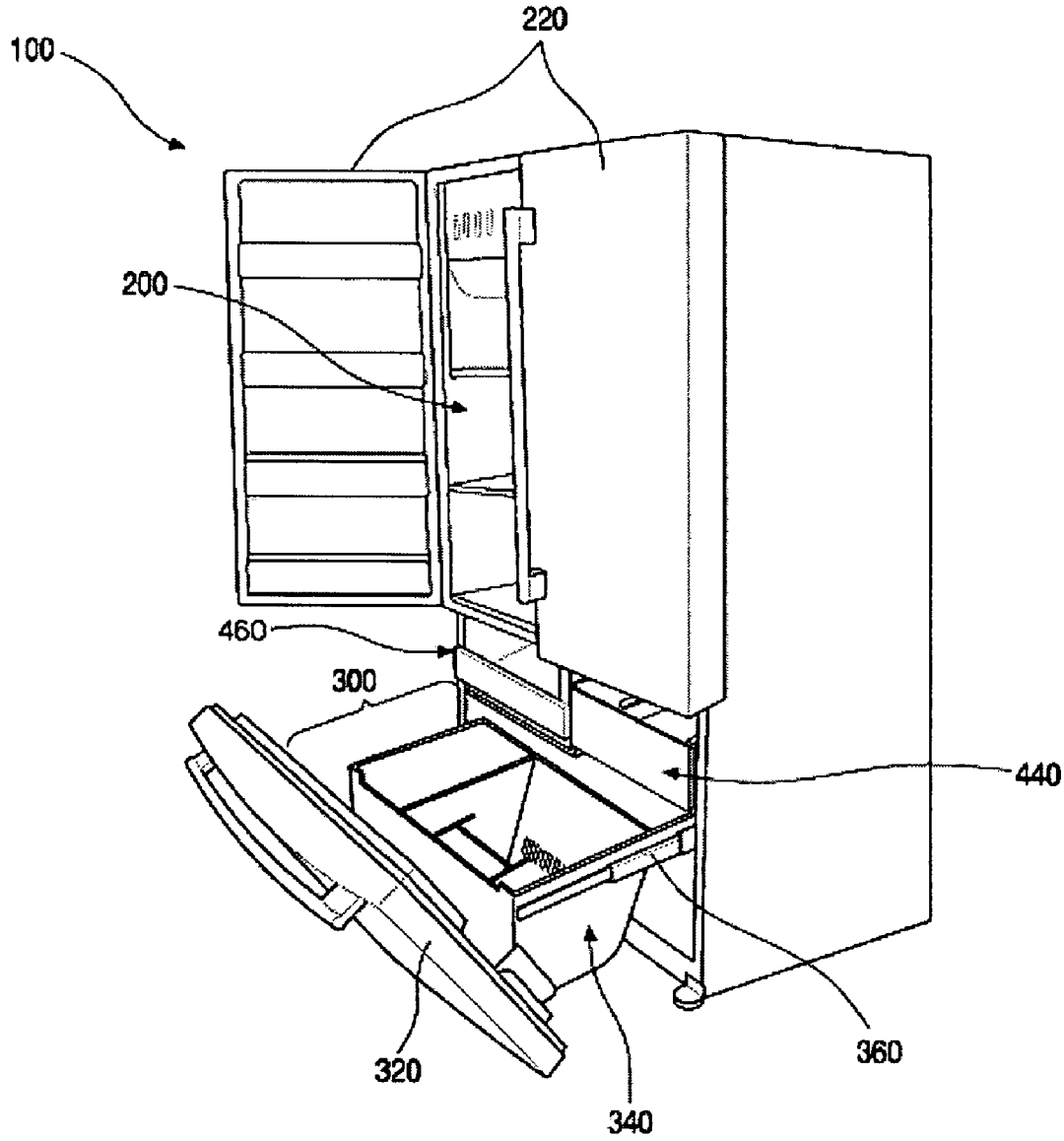

In the meantime, when the main drawer 460 is separated from the auxiliary drawer 440 and then each of the drawers is practically used as an independent accommodating space, as shown in FIGS. 29 and 30, the main drawer 460 is slidably mounted in auxiliary rails 480 of a refrigerator main body. The auxiliary rails 480 guide the slide of the main drawer 460, to which rolling members 462 are mounted, in the fore and aft direction.

Each of the auxiliary rails 480 is formed in an elongated quadrangular plate shape. A rail groove 482 is formed in a side of the auxiliary rail 480 so that each rolling member 462 of the main drawer 460 is inserted into the rail groove 482.

The rail grooves 482 are formed in substantially middle portions of the auxiliary rails 480 to be depressed with a length corresponding to the main drawer 460 so that the main drawer 460 slides in and out sufficiently. Therefore, the rolling members 462 of the main drawer 460 roll in the rail grooves 482, thus causing the main drawer 460 to slide in and out.

The auxiliary rails 480 are formed in the same configuration as the guide rails 420, so that the auxiliary rails 480 may be mounted at necessary positions in the refrigerator main body 100 and can be formed integrally in the refrigerator main body 100.

The auxiliary rails 480 may be mounted at any positions at which the main drawer 460 can be mounted in the refrigerator main body 100. In the embodiment of the present invention, the auxiliary rails 480 are mounted on the sides of the guide rails 420, i.e., in the upper left portion of the drawer chamber 300.

Hereinafter, the operation of the separable double drawer of a refrigerator according to the present invention so configured will be described with reference to the figures.

When the main drawer 460 and the auxiliary drawer 440 are separated from each other and used as respective independent accommodating spaces, in a state where the main drawer 460 is fully accommodated in the auxiliary drawer 440, the rolling members 462 of the main drawer 460 is caused to escape through the insertion portions 457 of the auxiliary drawer 440 by lifting the main drawer 460 upward.

After the main drawer 460 is separated from the auxiliary drawer 440 by allowing the rolling members 462 to escape, the main drawer 460 is mounted to the auxiliary rails 480 provided in the upper left portion of the drawer chamber 300. At this time, by mounting the rolling members 462 of the main drawer 460 to the rail grooves 482 formed in the auxiliary rails 480, the main drawer 460 can slide in and out in the fore and aft direction.

In addition, the auxiliary drawer 440 slides in and out when the auxiliary drawer 440 is mounted to the guide rails 420, and provides an additional accommodating space. At this time, the auxiliary drawer door 471 mounted to the auxiliary drawer 440 causes the front face of the auxiliary drawer 440 to be closed.

When the main drawer 460 is seated in the auxiliary drawer 440 and thus used as the double drawer 400, the auxiliary drawer door 471 is mounted on the bottom surface of the auxiliary drawer 440 in order not to prevent the main drawer 460 from sliding in and out.

When the main drawer 460 is separated from the auxiliary drawer 440, the auxiliary drawer door 471 slides out of the door guides 473 forward after the separated main drawer 460 is mounted to the auxiliary rails 480. Then, the auxiliary drawer door 471 pivots upward and the fixing protrusions 472 of the auxiliary drawer door 471 are inserted into and fixed to the fixing grooves 474.

Therefore, the main drawer 460 and the auxiliary drawer 440 define the respective independent accommodating spaces. When the main drawer 460 is seated in the auxiliary drawer 440 again in order to utilize the spaces of the drawer chamber 300, in reverse order of the above process, after the auxiliary drawer door 471 is mounted on the bottom surface of the auxiliary drawer 440, the main drawer 460 is seated in the auxiliary drawer 440 to be used.

In such an embodiment, when the main drawer 460 is separated from the auxiliary drawer 440 and they are used as the respective independent accommodating spaces, the auxiliary rails 480 to which the main drawer 460 is mounted are provided in the upper left portion of the drawer chamber 300. However, the auxiliary rails 480 may be provided, if desired, in the drawer chamber 300 or the refrigerating chamber 200. A plurality of the auxiliary rails 480 may be configured to have the same size, so that they can be used at any positions.

Figure 31:
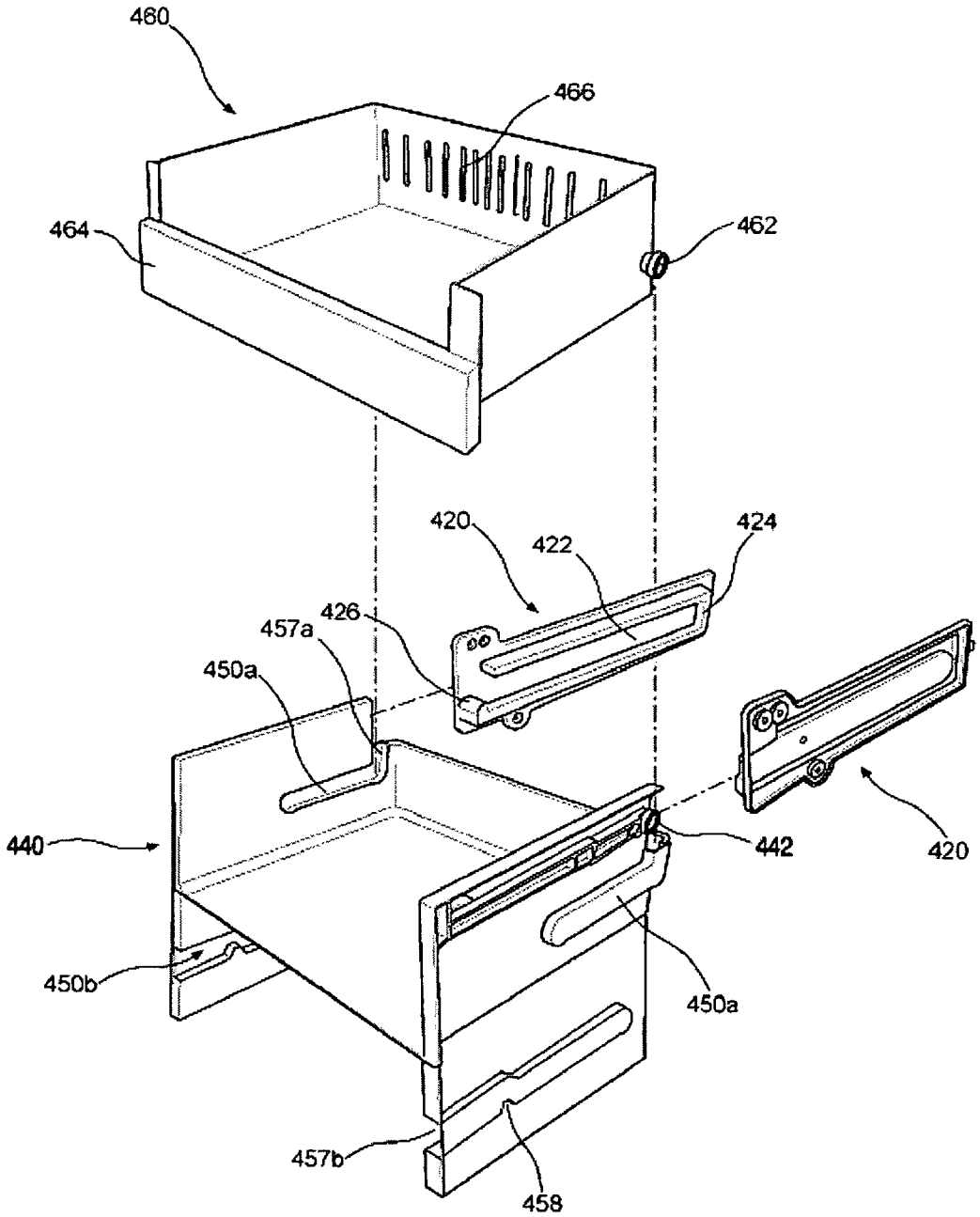
FIG. 31 is an exploded perspective view showing a refrigerator double drawer according to an eighth embodiment of the present invention, in which the installation position of an auxiliary drawer is variously changed.
Figure 32:
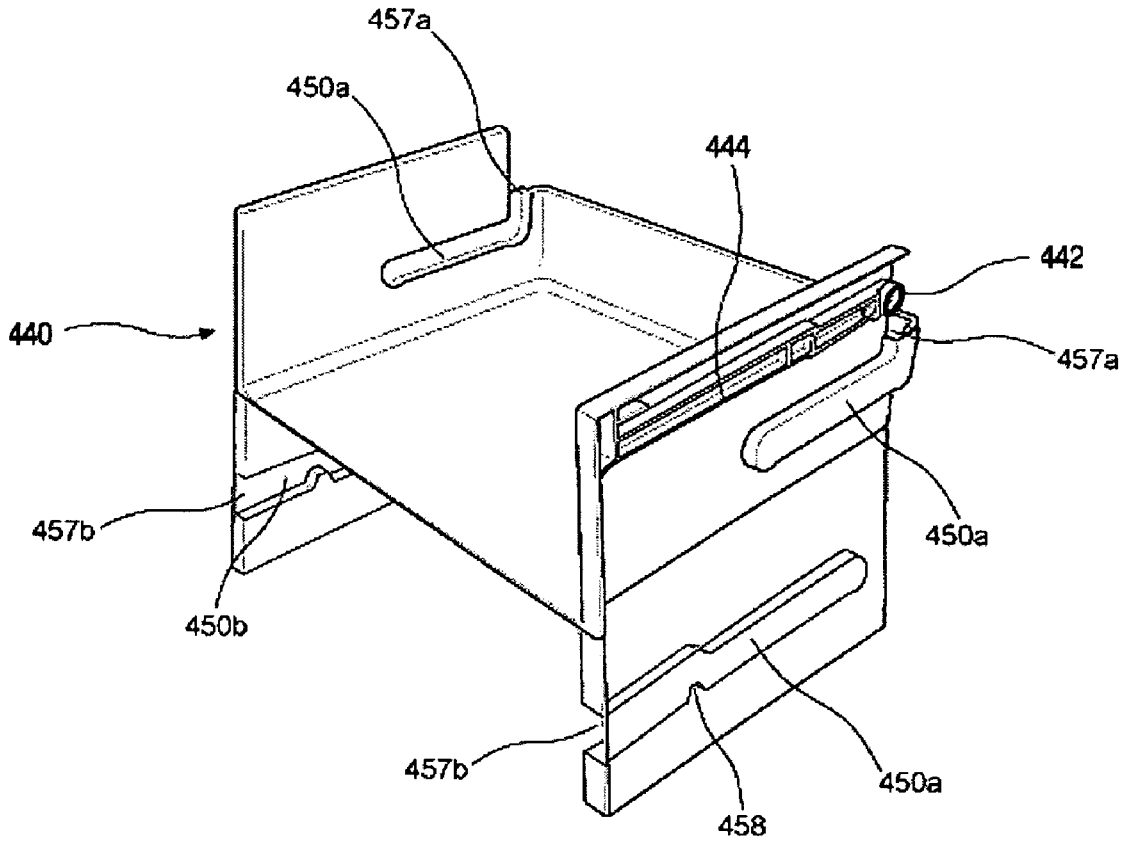
FIG. 32 is a perspective view showing the auxiliary drawer separated from the refrigerator double drawer shown in FIG. 31.
Figure 33:
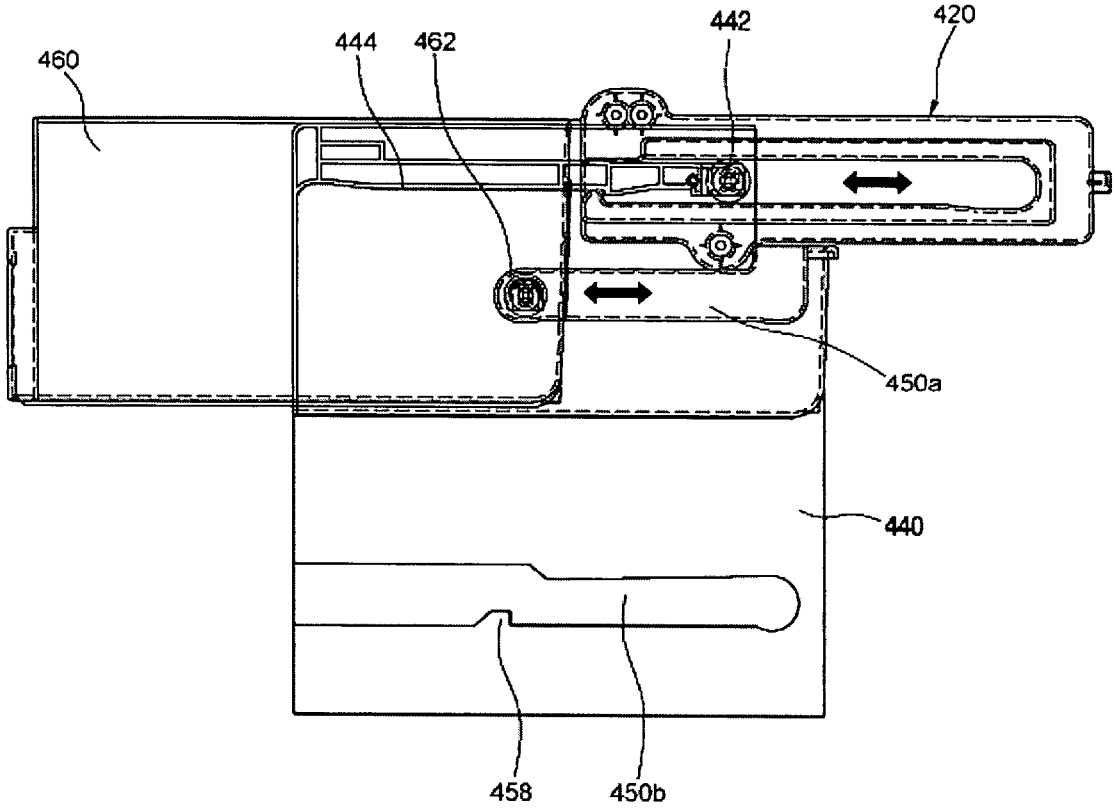
FIGS. 33 and 34 are sectional views for explaining the operation of the refrigerator double drawer shown in FIGS. 31 and 32.
Figure 34:
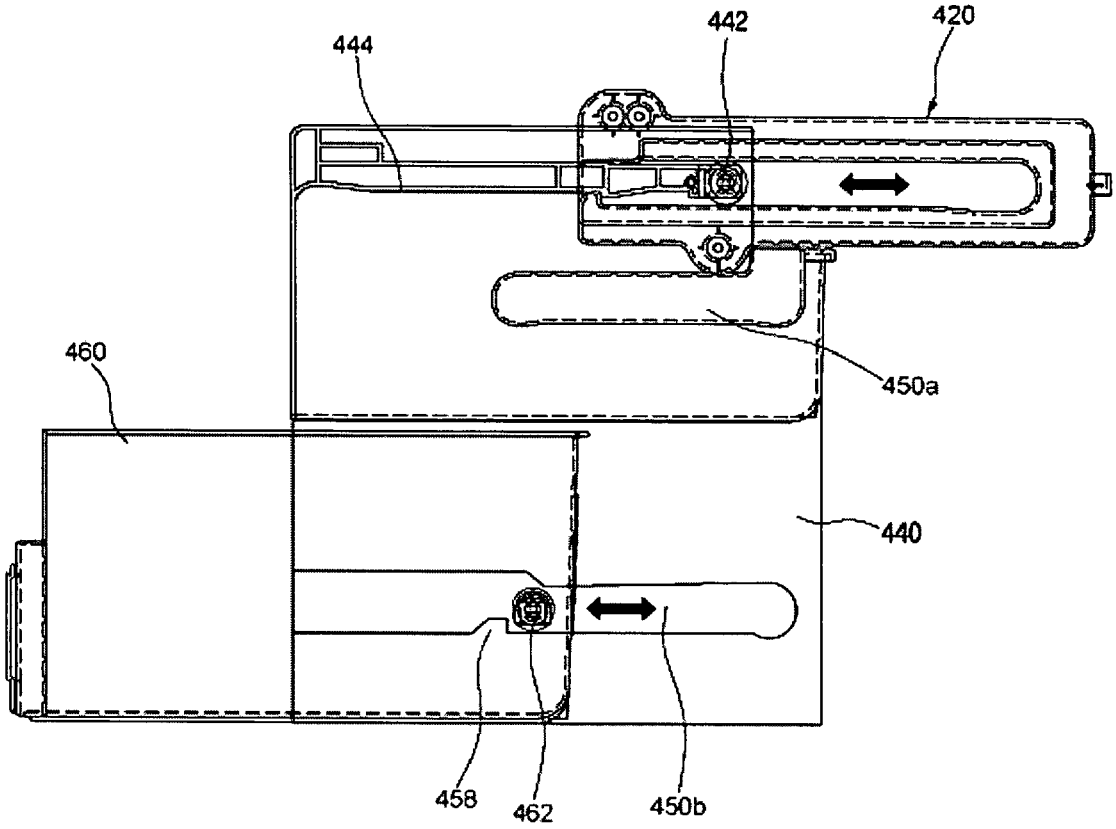

FIGS. 31 to 34 are views for illustrating a refrigerator double drawer according to an eighth embodiment of the present invention. FIG. 31 is an exploded perspective view showing the refrigerator double drawer according to the present embodiment; FIG. 32 is a perspective view showing an auxiliary drawer that is one of major portions of the present embodiment; FIG. 33 is a side view showing the main drawer that is one of the major portions of the refrigerator double drawer according to the present embodiment, wherein the main drawer is mounted on upper drawing rails; and FIG. 34 is a side view showing the main drawer that is one of the major portions of the refrigerator double drawer according to the present embodiment, wherein the main drawer is mounted on lower drawing rails.

As shown in FIGS. 31 and 32, an auxiliary drawer 440 according to the present embodiment is formed to be in the form of a drawer larger than a main drawer 460 in order for the main drawer 460 to be seated in the auxiliary drawer 440. The front face of the auxiliary drawer 440 is fully opened, so that the main drawer 460 seated in the auxiliary drawer 440 is caused to easily slide forward. The upper face of the auxiliary drawer 440 is opened, thus making it easy to check the inside of the main drawer 460 and to accommodate foods in the auxiliary drawer 440.

In addition, the auxiliary drawer 440 is formed with a rear upper portion and both rear side walls thereof being opened, thus making it easy to mount the auxiliary drawer 440 to guide rails 420. Further, both side walls of the auxiliary drawer 440 are formed to vertically extend downward by a predetermined length.

Upper drawing rails 450*a* are formed on upper portions of both the side walls of the auxiliary drawer 440, respectively. The upper drawing rails 450*a*, which guide the rolling of first rolling members 462 formed on both side walls of the main drawer 460, are formed to protrude outward at positions corresponding to the first rolling members 462 when the main drawer 460 is seated in the auxiliary drawer 440 so that the first rolling members 462 are accommodated in the upper drawing rails 450*a*. At this time, the sliding members 462' (see FIG. 23) integrally formed on the main drawer may be used instead of the first rolling members 462.

In addition, upper insertion portions 457*a* are formed in the rear ends of the upper drawing rails 450*a*. The upper insertion portions 457*a*, which are passages for insertion of the first rolling members 462, are formed to be opened upward at the rear ends of the upper drawing rails 450*a*.

Therefore, in order to allow the main drawer 460 to be securely seated in the auxiliary drawer 440, the first rolling members 462 formed on both the side surfaces of the main drawer 460 are positioned in the upper insertion portions 457*a* of the auxiliary drawer 440. Then, the main drawer 460 is inserted into the upper drawing rails 450*a*, so that the main drawer 460 is seated in the auxiliary drawer 440.

In the meantime, lower drawing rails 450*b* are formed on lower portions of both the side walls of the auxiliary drawer 440, respectively. The lower drawing rails 450*b* are mounted with the main drawer 460 separated from the upper drawing rails 450*a* when the user intends to expand the accommodating space in the refrigerator. The first rolling members 462 provided on both the side surfaces of the main drawer 460 are seated and roll in the lower drawing rails 450*b*.

The lower drawing rails 450*b* are formed to extend from the front to rear ends of the auxiliary drawer 440. Lower insertion portions 457*b* are formed at the front ends of the lower drawing rails 450*b*. The lower insertion portions 457*b* are formed to be opened at the front ends of both the side walls of the auxiliary drawer 440 so that the first rolling members 462 of the main drawer 460 can be inserted into and escape from the lower insertion portions 457*b*.

Therefore, in order for the user to mount the main drawer 460 separated from the upper drawing rails 450*a* to the lower drawing rails 450*b*, by inserting the first rolling members 462 into the lower insertion portions 457*b* and pushing the main drawer 460 rearward, the first rolling members 462 roll up to the rear ends of the lower drawing rails 450*b* and thus the main drawer 460 slides in the auxiliary drawer 440.

In order to stop the main drawer 460 from sliding out when the main drawer 460 fully slides out of the lower drawing rails 450*b*, catching portions 458 for limiting the rolling of the first rolling members 462 are formed on substantially middle portions of the lower drawing rails 450*b*, respectively.

The catching portions 458 are formed to protrude upward by a predetermined height larger than a radius of the first rolling members 462 so that the first rolling members 462 are caught to the catching portions 458 and thus the rolling of the first rolling members 462 is limited during the rolling of the first rolling members 462.

The portions of the catching portions 458 to which the first rolling members 462 are caught when the main drawer 460 slides out are vertically formed so as to effectively limit the rolling of the first rolling members 462. The portions of the catching portions 458 which the first rolling members 462 are brought into contact with when the main drawer is mounted are formed slantingly at a predetermined angle so that the first rolling members 462 effectively go over the catching portions 458.

In addition, in order for the main drawer 460 not to escape easily when the main drawer 460, which is mounted to the lower drawing rails 450*b* and completely accommodated therein, slides out of the lower drawing rails 450*b*, a width between the upper and lower portions of each lower drawing rail 450*b* in the range from the rear end of the lower drawing rail 450*b* to the catching portion 458 is somewhat larger than the diameter of the first rolling member 462.

On the other hand, a width between the upper and lower portions of each lower drawing rail 450*b* in the range from the front end of the lower drawing rail 450*b* to the catching portion 458 is larger than the diameter of the first rolling member 462 by the height of the catching portion 458 so that the first rolling members 462 go over the catching portions 458 effectively when the first rolling members 462 are mounted to the lower drawing rails 450*b*.

In the meantime, second rolling members 442 are provided on both the side surfaces of the auxiliary drawer 440 formed with the upper and lower drawing rails 450*a* and 450*b*. The second rolling members 442 which cause the auxiliary drawer 440 to slide along the guide rails 420 to be described below have the same configuration as the first rolling members 462.

Hereinafter, the operation of the aforementioned refrigerator double drawer will be described with reference to FIGS. 33 and 34.

As shown in the figures, in the double drawer 400, when the main drawer 460 is used in a state where it is mounted to the upper drawing rails 450*a*, the first rolling members 462 of the main drawer 460 are accommodated in the upper drawing rails 450*a* and roll in the upper drawing rails 450*a*. The rolling of the first rolling members 462 causes the main drawer 460 to be slid.

At this time, in a state where the main drawer 460 is completely accommodated in the auxiliary drawer 440, the first rolling members 462 are positioned at the rear ends of the upper drawing rails 450*a*. When the front plate 464 formed in the front of the main drawer 460 is pulled forward, the first rolling members 462 roll forward along the upper drawing rails 450*a*, so that the main drawer 460 slides out forward.

At the same time, the second rolling members 442 of the auxiliary drawer 440 roll forward along the guide rails 420, so that the auxiliary drawer 440 is guided by the guide rails 420 and slides out forward.

Therefore, since the protrusion of the auxiliary drawer 440 is added to the protrusion of the main drawer 460, the main drawer 460 more protrudes to the outside from the inside of the drawer chamber 300 (see FIG. 3), so that foods are taken out through the open upper face of the main drawer 460 that is exposed to the outside.

In order to cause the double drawer 400 to slide in, when the front plate 464 of the main drawer 460 is pushed rearward, the first rolling members 462 roll rearward along the upper drawing rails 450*a* and the second rolling members 442 roll rearward along the guide rails 420. Thus, the main drawer 460 and the auxiliary drawer 440 are completely accommodated rearward.

Meanwhile, in order to accommodate foods necessary to be stored in a separate storage space or to be separately stored, by mounting the main drawer 460 to the lower portion of the auxiliary drawer 440, both of the auxiliary drawer 440 and the main drawer 460 can be practically used as spaces necessary for accommodating foods.

In detail, in order to separate the main drawer 460 from the upper drawing rails 450*a*, the main drawer 460 is pushed rearward so that the main drawer 460 is completely accommodated and the first rolling members 462 are positioned at the rear ends of the upper drawing rails 450*a*.

When the first rolling members 462 are positioned at the rear of the upper drawing rails 450*a*, the main drawer 460 is caused to be lifted up. At this time, the first rolling members 462 escape out through the upper insertion portions 457*a* formed at the rear ends of the upper drawing rails 450*a*, so that the main drawer 460 is separated from the auxiliary drawer 440.

Next, after moving the separated main drawer 460 to the lower front of the auxiliary drawer 440, the first rolling members 462 of the main drawer 460 are inserted into the lower insertion portions 457*b* formed to be opened at the front ends of both the side walls of the auxiliary drawer 440.

By pushing the main drawer 460 rearward after inserting the first rolling members 462 into the lower insertion portions 457*b* to be mounted to the lower drawing rails 450*b*, the first rolling members 462 roll rearward smoothly, go over the catching portions 458 formed in the lower drawing rails 450*b* and then are positioned at the rear ends of the lower drawing rails 450*b*, so that the main drawer 460 is completely mounted to the lower drawing rails 450*b*.

When the main drawer 460 is mounted to the lower drawing rails 450*b* as described above, the upper portion of the auxiliary drawer 440 is used as an accommodating space, i.e., an independent tray, while the main drawer 460 provides an additional accommodating space to the lower portion of the auxiliary drawer 440.

In the meantime, if the front plate 464 is gripped and pulled out in order to cause the main drawer 460 to slide out when the main drawer 460 is mounted to the lower drawing rails 450*b*, the first rolling members 462 roll forward in the lower drawing rails 450*b* and thus cause the main drawer 460 to slide out forward.

Further, the first rolling members 462 roll and move up to the catching portions 458 in the lower drawing rails 450*b*. When the catching portions 458 and the first rolling members 462 are brought into contact with each other, the rolling of the first rolling members 462 is limited by the catching portions 458, so that the main drawer 460 is stopped from sliding out.

At the same time, the second rolling members 442 of the auxiliary drawer 440 roll forward in the receiving portions 422 of the guide rails 420, so that the auxiliary drawer 440 slides out forward.

The forward slide of the auxiliary drawer 440 causes the main drawer 460 to more protrude outward. Thus, the portion of the auxiliary drawer 440, which functions as a tray, is exposed to the outside. Further, the main drawer 460 slides out along the lower drawing rails 450*b* and is exposed to the outside. Thus, the user is enabled to accommodate foods in the tray of the auxiliary drawer 440 and the main drawer 460.

In order to cause the double drawer 400 to slide in, by pushing the front plate 464 rearward, the double drawer slides in the reverse order of the foregoing.

In the meantime, in order to separate the main drawer 460 from the lower drawing rails 450*b* and mount the main drawer 460 to the upper drawing rails 450*a* again, when the main drawer 460 slides out forward and then the first rolling members 462 are positioned to the catching portions 458, the main drawer 460 is caused to slide out forward after it is lifted at a predetermined height.

When the main drawer 460 slides out continuously after going over the catching portions 458, the first rolling members 462 escape to the outside through the lower insertion portions 457*b* in the front of the lower drawing rails 450*b*, so that the main drawer 460 is separated from the auxiliary drawer 440.

Next, after moving the main drawer 460 to the upper portion of the auxiliary drawer 440, the first rolling members 462 are inserted into the upper insertion portions 457*a* formed in the rear ends of the upper drawing rails 450*a*. When the first rolling members 462 are inserted into the upper insertion portions 457*a*, the first rolling members 462 are positioned at the rear ends of the upper drawing rails 450*a*, so that the main drawer 460 is seated in the auxiliary drawer 440.

Figure 35:
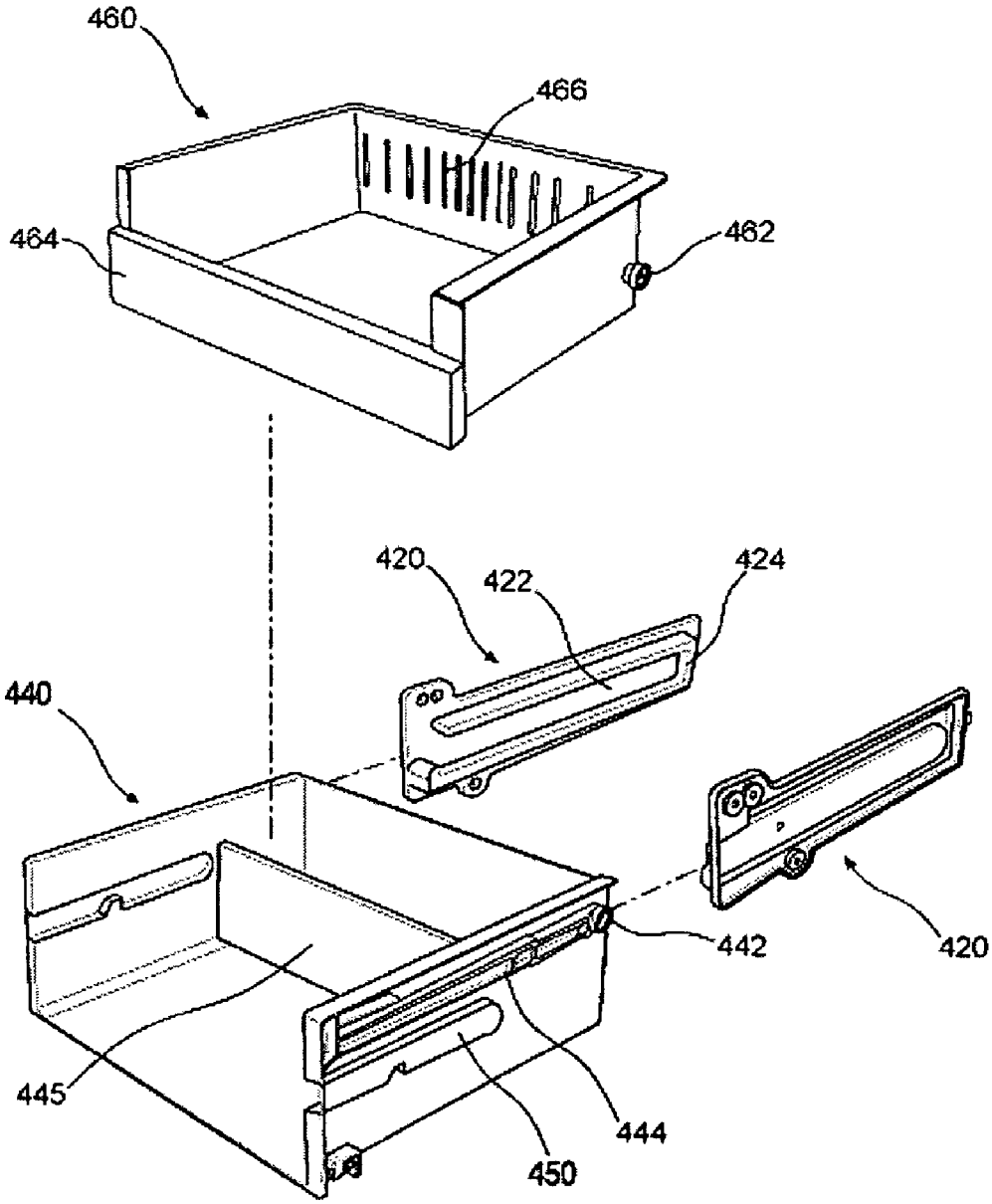
FIG. 35 is an exploded perspective view showing a refrigerator double drawer according to a ninth embodiment of the present invention, which comprises an auxiliary drawer having a partition.
Figure 36:
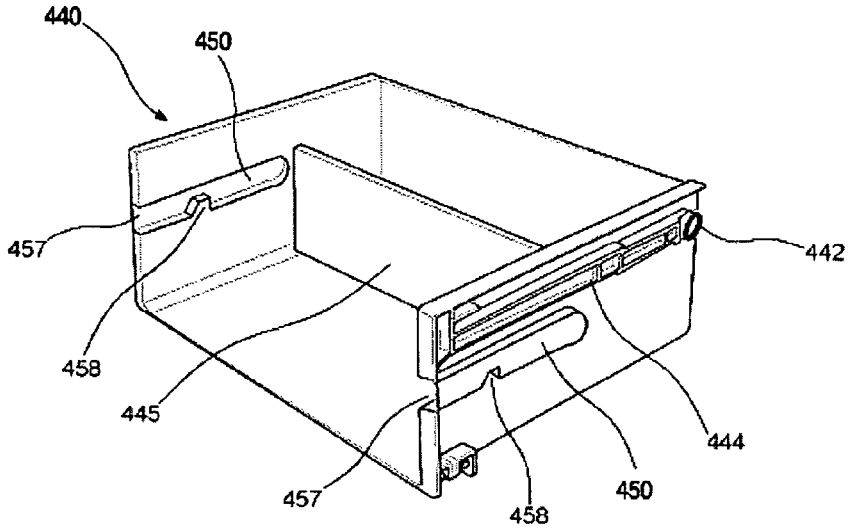
FIG. 36 is a perspective view showing the auxiliary drawer separated from the refrigerator double drawer shown in FIG. 35.
Figure 37:
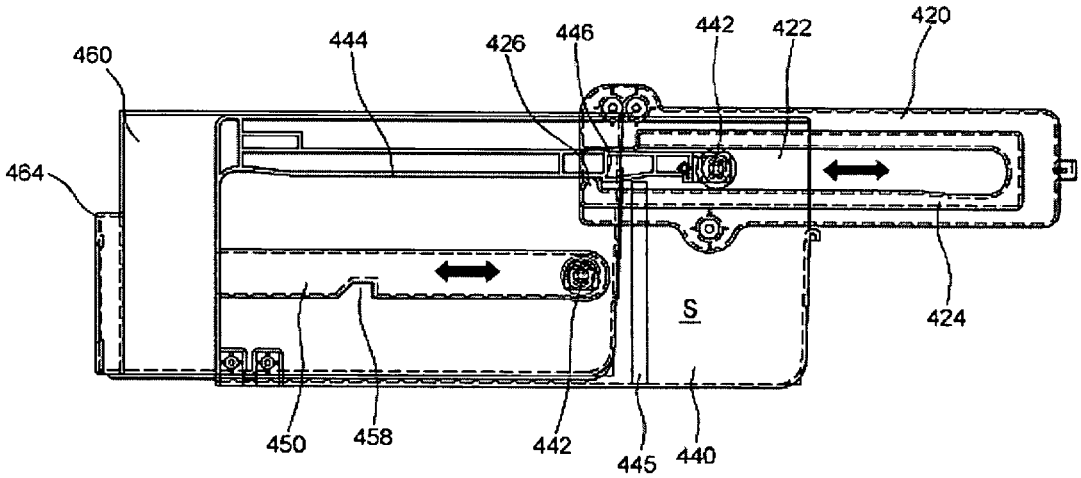
FIG. 37 is a sectional view for explaining the operation of the refrigerator double drawer shown in FIGS. 35 and 36

FIGS. 35 to 37 are views for illustrating a refrigerator double drawer according to a ninth embodiment of the present invention. FIG. 35 is an exploded perspective view showing the refrigerator double drawer according to the present embodiment; FIG. 36 is a perspective view showing an auxiliary drawer as a major portion of the present embodiment; and FIG. 37 is a schematic view illustrating the operation of the refrigerator double drawer according to the present embodiment.

As shown in FIGS. 35 to 37, a front face of an auxiliary drawer 440 of the present embodiment is completely opened, which makes it easy to cause a main drawer 460 seated in the auxiliary drawer 440 to slide out forward, while an upper face of an auxiliary drawer 440 is opened, which makes it more easy to check the inside of the main drawer 460 and to accommodate food therein.

In addition, a partition 445 for partitioning the auxiliary drawer 440 into front and rear sections is provided in the auxiliary drawer 440. The partition 445 vertically protrudes on a floor surface of the auxiliary drawer 440 upward by about a height of the auxiliary drawer 440.

The length from the front end of the floor surface of the auxiliary drawer 440 to the partition 445 is not longer than the length between the front and rear ends on a floor surface of the main drawer 460. Therefore, when the main drawer 460 slides in rearward after being seated in the auxiliary drawer 440, the rear surface of the main drawer 460 is brought into contact with the partition 445.

At this time, the partition 445 is formed with the height such that all of cold air inlets 466 formed in the rear wall of the main drawer 460 are not closed in order for the cold air to be introduced into the main drawer 460 smoothly.

The length from the rear end of the floor surface of the auxiliary drawer 440 to the partition 445 may be determined arbitrary according to use. The partition 445 causes an additional storage space S to be formed in the rear of the partition 445 in the auxiliary drawer 440, so that the food necessary to be separated can be stored.

In the meantime, drawing rails 450 are formed on both side walls of the auxiliary drawer 440. The drawing rails 450, which guide the rolling of first rolling members 462 provided on both side surfaces of the main drawer 460, are formed to extend from the front ends of both the side walls of the auxiliary drawer 440 to positions at which the partition 445 is formed.

Insertion portions 457 which are passages for insertion of the first rolling members 462, are defined at the front ends of the drawing rails 450. Each of the insertion openings 457 is defined to be opened at the front of the auxiliary drawer 440 and to have a diameter somewhat larger than that of the first rolling member 462 in order for the first rolling member 462 to be easily inserted therein.

Catching portions 458 are formed in the drawing rails 450, respectively. The catching portions 458, which limit the additional sliding motion of the main drawer 460 when the main drawer 460 completely slides out, are formed to protrude upward by a predetermined height.

In the meantime, second rolling members 442 are provided on both side surfaces of the auxiliary drawer 440 to which the drawing rails 450 are mounted. The second rolling members 442, which cause the auxiliary drawer 440 to slide along guide rails 420 to be described below, have the same configuration as the first rolling members 462.

The second rolling members 442 are installed on upper portion, i.e., above the drawing rails 450, at rear portions of both the side surfaces of the auxiliary drawer 440. Sliding guides 444 are formed from positions at which the second rolling members 442 are provided to the front ends of the auxiliary drawer 440.

The sliding guides 444, which cause the auxiliary drawer 440 not to sag when the auxiliary drawer 440 slides in and out, are formed to protrude outward with a predetermined width.

The auxiliary drawer 440 is mounted to the guide rails 420. The guide rails 420, which guide the slide of the auxiliary drawer 440, are installed on the left and right sides of the refrigerator main body 100, particularly, on the upper left and right side surfaces of the drawer chamber 300 (see FIG. 3), respectively.

A protrusion 424 and a receiving portion 422, which extend in the longitudinal direction of each guide rail 420, are formed on the middle portion of each guide rail 420 which is formed in a rectangular plate shape.

The protrusion 424 is formed along the peripheral portion of the guide rail 420 to protrude inward by a predetermined distance with a predetermined width. Therefore, the receiving portion 422 is naturally defined to be depressed in the inside of the portion in which the protrusion 424 is formed. The shape of the receiving portion 422 is determined according to the shape of the protrusion 424.

The receiving portion 422, which the second rolling member 442 is in contact with and rolls in, is formed with a predetermined width so that the second rolling member 442 can stably rolls and moves.

Hereinafter, the operation of the refrigerator double drawer so configured will be described with reference to FIG. 37.

When a user causes the main drawer 460 to slide out forward completely, the auxiliary drawer 440 also slides out forward. The additional storage space S defined by the partition 445 in the rear portion of the auxiliary drawer 440 is also exposed to the outside, so that the food necessary to be separated can be stored in the additional storage space S.

In order to cause the double drawer 400 to slide in after foods are accommodated in or taken out of the main drawer 460 or the additional storage space S in the auxiliary drawer 440 defined by the partition 445, by gripping the front plate 464 and pushing it rearward, the first rolling members 462 roll in the drawing rails 450 rearward.

When the first rolling members 462 roll up to the rear ends of the drawing rails 450, the rear surface of the main drawer 460 is brought into contact with the partition 445. When the user pushes it rearward continuously, the second rolling members 442 mounted to the auxiliary drawer 440 roll along the guide rails 420 and thus cause the auxiliary drawer 440 to slide in.

Therefore, the main drawer 460 and the auxiliary drawer 440 are completely accommodated in the drawer chamber 300, and the additional storage space S in the auxiliary drawer 440 defined by the partition 445 is also accommodated in the drawer chamber 300.

As described above, the present invention provides the refrigerator double drawer, which comprises a main drawer, an auxiliary drawer having drawing rails which assist the main drawer to slide out, and guide rails assisting the auxiliary drawer to slide out. Thus, there are advantages in that an extended length of the main drawer can be increased, and the durability can also be improved since the main drawer can withstand a moment resulting from the weight of the foods accommodated in the main drawer by the extended length in spite of the increase in the extended length.

In addition, the present invention causes the parts of the double drawer to be easily disassembled, and thus there is an advantage in that the cleaning and management of the double drawer can be easily performed. Further, according to the present invention, the reinforcing ribs formed on the main drawer causes the strength of the main drawer to be considerably increased. The present invention has also an advantage in that the noise and the damage of the double drawer caused from the collision between the main drawer and the auxiliary drawer can be prevented.

Further, according to the present invention, since the main drawer can be detachably mounted in the auxiliary drawer and the main drawer can be selectively mounted to the upper and lower drawing rails of the auxiliary drawer, there is an advantage in that the space efficiency in a refrigerator main body is considerably increased.

Furthermore, since the present invention has the configuration so that the main drawer and the auxiliary drawer can slide in and out successively, there is also an advantage in that it is possible for a user to use the double drawer conveniently.

The present invention has been described based on the specific embodiments. However, it will be apparent that those skilled in the art can make various modifications, alterations and changes within the scope of the invention defined by the claims. Therefore, the aforementioned descriptions and the accompanying drawings should be construed not as limiting the technical spirit of the present invention but as illustrating the present invention.

What is claimed is:

1. A double drawer of a refrigerator, comprising:

a main drawer having a predetermined space defined therein for accommodating foods;

an auxiliary drawer having an inner space defined therein for accommodating the main drawer, the auxiliary drawer including drawing rails provided on both inside surfaces of the auxiliary drawer for guiding the main drawer to slide in a fore and aft direction and allowing the main drawer to slide in and out of the auxiliary drawer;

guide rails installed in a main body of the refrigerator to guide the auxiliary drawer to slide in the fore and aft direction; and rolling members, which roll along the drawing rails, provided on both side surfaces of the main drawer to allow the main drawer to be smoothly slid, wherein each of the drawing rails comprises:

a first main drawer guiding portion, and a second portion having a first end meeting the first main drawer guiding portion at an end of the main drawer guiding portion and extending upwardly therefrom to a second end of the second portion.

2. The double drawer as claimed in claim 1, wherein the drawing rails are lower than the guide rails.

3. The double drawer as claimed in claim 2, wherein depressed seating portions are formed at both side ends of the drawing rail to allow the rolling member to be seated therein.

4. The double drawer as claimed in claim 3, wherein the seating portions are formed to limit a rolling motion of the rolling member and a resultant sliding motion of the main drawer against a predetermined sliding force applied to the main drawer or auxiliary drawer, the sliding force being determined to cause the auxiliary drawer to slide, whereby the main drawer and auxiliary drawer can be sequentially slid.

5. The double drawer as claimed in claim 1, wherein the drawing rails are integrally formed on the auxiliary drawer.

6. The double drawer as claimed in claim 1, wherein rolling members, which roll along the guide rails and allow the auxiliary drawer to be smoothly slid, are provided on both side surfaces of the auxiliary drawer.

7. The double drawer as claimed in claim 6, wherein the rolling members are provided on upper rear end on both side surfaces of the auxiliary drawer.

8. The double drawer as claimed in claim 1, wherein sliding guides, which are slidably mounted in the guide rails to guide the sliding motion of the auxiliary drawer, are formed to protrude from both side walls of the auxiliary drawer.

9. The double drawer as claimed in claim 8, wherein rolling members, which roll along the guide rails and to allow the auxiliary drawer to be smoothly slid, are provided at positions corresponding to the sliding guides on both side surfaces of the auxiliary drawer.

10. The double drawer as claimed in claim 1, wherein the auxiliary drawer is formed in a box shape with front and upper faces thereof opened.

11. The double drawer as claimed in claim 1, wherein the auxiliary drawer are formed with one or more connection portions connecting both side walls of the auxiliary drawer to each other, the connection portions being formed to traverse both the side walls of the auxiliary drawer.

12. The double drawer as claimed in claim 11, wherein the connection portions are formed in a rear surface of the auxiliary drawer.

13. The double drawer as claimed in claim 11, wherein the connection portions are formed in a bottom surface of the auxiliary drawer.

14. The double drawer as claimed in claim 12 or 13, wherein the auxiliary drawer is opened toward all faces except both side surfaces and bottom surface thereof.

15. The double drawer as claimed in claim 12 or 13, wherein the auxiliary drawer is opened toward all faces except both side surfaces and the rear surface.

16. The double drawer as claimed in claim 2, wherein the drawing rail is formed to extend from a rear end the auxiliary drawer to a front end of the auxiliary drawer, and is formed with a rolling member insertion opening at the second end of the second portion which is opened forward for insertion of the rolling member to guide forward insertion of the main drawer.

17. The double drawer as claimed in claim 16, wherein the drawing rail is formed stepwise so that a bottom surface of an upper step portion thereof is positioned above a bottom surface of a lower step portion thereof.

18. The double drawer as claimed in claim 16, wherein the drawing rail comprises: a movable portion extending from the rear end to a middle portion of the side wall of the auxiliary drawer to guide the movement of the rolling member; the second portion comprises a vertical portion extending vertically upward at an extended end of the movable portion to prevent the main drawer from coming off, and an insertion portion extending from an upper end of the vertical portion of the auxiliary drawer to the front end of the side wall of the auxiliary drawer, the insertion portion being a passage for insertion of the rolling member.

19. The double drawer as claimed in claim 1, wherein the main drawer is formed with a reinforcing rib for reinforcing the main drawer.

20. The double drawer as claimed in claim 19, wherein a plurality of the reinforcing ribs are formed on a bottom surface of the main drawer in a fore and aft direction thereof.

21. The double drawer as claimed in claim 19, wherein the reinforcing rib is formed to protrude downward from a bottom surface of the main drawer.

22. The double drawer as claimed in claim 21, wherein a lower end of the reinforcing rib slides on the auxiliary drawer while being brought into contact with the auxiliary drawer.

23. The double drawer as claimed in claim 1, wherein a rolling member for allowing the auxiliary drawer to easily move in a fore and aft direction thereof and a sliding guide for guiding the auxiliary drawer to move in the fore and aft direction are provided on each side surface of the auxiliary drawer, and a receiving portion is formed on the guide rail in the fore and aft direction to receive both the rolling member and the sliding guide and to slidably guide the rolling member and the guide rail.

24. The double drawer as claimed in claim 23, wherein the receiving portion and the sliding guide are formed with a rail catching portion and a guide catching portion, respectively, which are formed in a shape corresponding to each other to be caught to each other.

25. The double drawer as claimed in claim 24, wherein the rail catching portion is formed at a front end of the receiving portion.

26. The double drawer as claimed in claim 1, wherein at least one of the main drawer and the auxiliary drawer is provided with a shock absorbing member for alleviating collision between the auxiliary drawer and the main drawer.

27. The double drawer as claimed in claim 26, wherein the shock absorbing member is formed at a front end of the auxiliary drawer.

28. The double drawer as claimed in claim 26, wherein the shock absorbing member is formed of an elastic material.

29. The double drawer as claimed in claim 28, wherein the shock absorbing member is formed of a rubber material.

30. The double drawer as claimed in claim 1, wherein each of the drawing rails includes an opening type drawing rail formed to be bored through each side wall of the auxiliary drawer, and sliding members are formed on both side surfaces of the main drawer to be fitted into and slid along the opening type drawing rails.

31. The double drawer as claimed in claim 30, wherein the opening type drawing rail is formed to extend from a rear end at least to a middle portion of the auxiliary drawer.

32. The double drawer as claimed in claim 30, wherein seating portions are formed to be depressed downward at both side ends of each opening type drawing rail, each seating portion being somewhat larger than the sliding member.

33. The double drawer as claimed in claim 32, wherein the seating portions are formed to limit a sliding motion of the sliding member and the main drawer against a predetermined sliding force applied to the main drawer or auxiliary drawer, the force being determined to cause the auxiliary drawer to slide, whereby the main drawer and the auxiliary drawer can be sequentially slid.

34. The double drawer as claimed in claim 1, wherein the main drawer is selectively separated from the auxiliary drawer and mounted to the auxiliary rails, and an auxiliary drawer door is provided on the auxiliary drawer to selectively close a face of the auxiliary drawer, thereby defining an additional accommodating space in the auxiliary drawer.

35. The double drawer as claimed in claim 34, wherein the auxiliary drawer further comprises door guides in which the auxiliary drawer door is accommodated to guide a forward sliding motion of the auxiliary drawer door.

36. The double drawer as claimed in claim 34, wherein the auxiliary drawer door slides out forward and pivots upward when the auxiliary drawer is closed and is mounted on a bottom surface of the auxiliary drawer when the auxiliary drawer is opened.

37. The double drawer as claimed in claim 1, wherein the drawing rails comprise upper drawing rails and lower drawing rails, and the main drawer is selectively mounted on the upper drawing rails and lower drawing rails.

38. The double drawer as claimed in claim 37, wherein the lower drawing rails are formed to extend from a front end of the side wall to a rear end of the side wall of the auxiliary drawer.

39. The double drawer as claimed in claim 1, wherein the auxiliary drawer further comprises a partition for partitioning an inner space of the auxiliary drawer.

40. The double drawer as claimed in claim 39, wherein a length between front and rear ends on a floor surface of the main drawer is equal to or slightly larger than a length from a front end on a floor surface of the auxiliary drawer to the partition.

41. The double drawer as claimed in claim 39, wherein the drawing rails are formed to extend from positions, at which the partition is formed, to front ends of both side walls of the auxiliary drawer.

42. The double drawer as claimed in claim 41, wherein catching portions are formed on the drawing rails to protrude upward, thereby preventing the rolling member provided on both side surfaces of the main drawer from sliding out.

43. A double drawer of a refrigerator, comprising:

a main drawer having a predetermined space defined therein for accommodating foods;

an auxiliary drawer having a bottom wall and a pair of side walls to form an inner space defined therein for accommodating the main drawer;

drawing rails formed on an inner surface of the auxiliary drawer side walls, the drawing rails cooperating with the main drawer to allow the main drawer to slide in and out of the auxiliary drawer;

sliding guides formed on the outer surface of the auxiliary drawer side walls, the sliding guides allowing the auxiliary drawer to slide in and out of the refrigerator; and rolling members, which roll along the drawing rails, provided on both side surfaces of the main drawer to allow the main drawer to be smoothly slid, wherein each of the drawing rails comprises:

a main drawer guiding portion, and a roll member inserting portion having a first end meeting the main drawer guiding portion at an end of the main drawer guiding portion and extending upwardly therefrom to a second end of the inserting portion.

44. The double drawer of claim 43, wherein the drawing rails are grooves formed in the inner surface of the auxiliary drawer side walls.

45. The double drawer of claim 43, further comprising:

a rolling member proximate each sliding guide.

* * * * *